US006927019B2

(12) United States Patent
Yoshida

(10) Patent No.: US 6,927,019 B2
(45) Date of Patent: Aug. 9, 2005

(54) CONCENTRATED COMPOSITION OF BLIX SOLUTION FOR SILVER HALIDE COLOR PHOTOGRAPHIC PHOTOSENSITIVE MATERIAL

(75) Inventor: Kazuaki Yoshida, Kanagawa (JP)

(73) Assignee: Fuji Photo Film Co., Ltd., Minami-Ashigara (JP)

( * ) Notice: Subject to any disclaimer, the term of this patent is extended or adjusted under 35 U.S.C. 154(b) by 11 days.

(21) Appl. No.: 10/621,360

(22) Filed: Jul. 18, 2003

(65) Prior Publication Data

US 2004/0023167 A1 Feb. 5, 2004

(30) Foreign Application Priority Data

Jul. 19, 2002 (JP) ..... P. 2002-211187

(51) Int. Cl.[7] ..... G03C 7/42
(52) U.S. Cl. ..... 430/450; 430/460
(58) Field of Search ..... 430/450, 460

(56) References Cited

U.S. PATENT DOCUMENTS 4,956,268 A 9/1990 Nakazyo et al.
5,391,467 A * 2/1995 Yoshida et al. ..... 430/434
5,565,310 A 10/1996 Kawai

FOREIGN PATENT DOCUMENTS

EP 0 567 126 A1 10/1993
JP 11-288068 10/1999

OTHER PUBLICATIONS

Abstract of DE 4402916 A1, Aug. 3, 1995.*
Abstract of JP4112888068A, Oct. 19, 1999.*
Search Report issued in European Patent Application No. 03 01 6322, on Sep. 17, 2003.

* cited by examiner

*Primary Examiner*—Hoa Van Le
(74) *Attorney, Agent, or Firm*—Burns, Doane, Swecker & Mathis, L.L.P.

(57) ABSTRACT

A concentrated blix solution composition, which can remarkably reduce the replenishing amount of the blix solution and/or remarkably reduce the blix time, comprises: 1) a concentrated composition part containing a bleaching agent; and 2) a concentrated composition part containing a fixing agent, wherein the part concentrated composition 1) satisfies all the following conditions: (1) pH is from 2.0 to 3.5, (2) a specific gravity is 1.130 or more, (3) the bleaching agent comprises an iron(III) complex salt of an aminopolycarboxylic acid, (4) a concentration of the bleaching agent is from 0.5 to 1.0 mole/L, and (5) a content of an aminopolycarboxylic acid having not been complexed is from 0.1 to 3% by mole based on the bleaching agent, and a processing process using the same.

12 Claims, No Drawings

CONCENTRATED COMPOSITION OF BLIX SOLUTION FOR SILVER HALIDE COLOR PHOTOGRAPHIC PHOTOSENSITIVE MATERIAL

FIELD OF THE INVENTION

The present invention relates to a photographic processing composition for a silver halide photographic photosensitive material (hereinafter, sometimes simply referred to as a "photosensitive material"), and more particularly, it relates to a highly concentrated liquid processing composition for bleaching and fixing having expedited processing suitability.

BACKGROUND OF THE INVENTION

In recent years, an automatic processing machine (automatic processor) called a "mini-laboratory" for processing photographic photosensitive materials over the counter is being widely spread for expediting services for ordinary users and rationalizes transportation for collection and delivery. A development processing agent for a mini-laboratory is often supplied in the form of a liquid composition formed by dissolving constitutional processing agents in a solvent, such as water because it has such an advantage that a processing solution can be prepared in a simple preparation operation upon use, such as mixing and dilution with water. However, the form of a liquid composition is disadvantageous from the standpoint of transport cost since it is associated with a container for housing a solvent, such as water, for dissolving the components of the processing agent and the composition, and therefore, it is generally supplied in the form of a liquid concentrated processing composition having been reduced in volume by enrichment (in this field of art, the term "concentration" is used instead of the term "enrichment").

The liquid concentrated processing agent for bleaching and fixing generally has a two-liquid constitution having higher stability than a one-liquid constitution, i.e., it is generally constituted from two parts, a concentrated composition part containing a bleaching agent (hereinafter, sometimes referred to as a bleaching agent part) and a concentrated composition part containing a fixing agent (hereinafter, sometimes referred to as a fixing agent part).

It is also demanded in the development process in a mini-laboratory in addition to the convenience in transportation described in the foregoing that the process is expedited for improving services for users, and the replenishment is reduced for decreasing the emission amount of waste liquids. In order to realize reduction of the replenishment and expedition of the process in the blix step, it is necessary that the concentration of the bleaching agent is increased, and the pH of the blix solution is lowered to maintain bleaching capability. The fixing agent part cannot have a low pH value since the fixing agent is decomposed or deposited by precipitation with a low pH value of the fixing agent part. However, in the case where the bleaching agent part has a low pH value with a high concentration of the bleaching agent, various kinds of components are deposited by precipitation depending on storage conditions or use conditions at either low temperatures or high temperatures, so as to cause troubles in operation in the laboratories and in processing agents. Moreover, it also causes such a problem that the time-lapse stability is deteriorated at a high temperature to lower the bleaching capability due to decomposition of the bleaching agent to a ferrous compound. Therefore, the high concentration and the low pH value of the bleaching agent part have not yet been simultaneously realized although they have been strongly demanded.

SUMMARY OF THE INVENTION

The invention has been developed under the foregoing circumstances, and a first object thereof is to provide such a concentrated blix solution composition that is prevented from precipitation and deposition at either low temperatures or high temperatures and is also prevented from generation of a ferrous compound upon stored at a high temperature.

A second object of the invention is to provide such a concentrated blix solution composition that remarkably reduce the replenishing amount of the blix solution, or remarkably reduce the blix time, or in alternative, realizes both of them.

A third object of the invention is to provide such a process for bleaching and fixing that remarkably reduce the replenishing amount of the blix solution, or remarkably reduce the blix time, or in alternative, realizes both of them.

The inventors have conducted earnest investigations with respect to various conditions of salt concentrations, pH values and temperatures in the constitutional components of the bleaching agent part, for which both an aminopolycarboxylic acid having not been complexed (hereinafter, referred to as a free aminopolycarboxylic acid) and an iron(III) complex salt of an aminopolycarboxylic acid are stably present in a dissolved state, and have found that even in the case of a high salt concentration of the iron(III) complex salt of an aminopolycarboxylic acid of 0.5 mole/L or more, there are specific ranges in the pH value and the concentration of the free aminopolycarboxylic acid, in which deposition at low temperatures and high temperatures and deterioration with the lapse of time can be prevented. Thus, the invention has been completed.

The objects of the invention can be attained by the invention having the following constitutions.

(1) A concentrated blix solution composition for a silver halide color photographic photosensitive material, which comprises: 1) a concentrated composition part containing a bleaching agent; and 2) a concentrated composition part containing a fixing agent, wherein the concentrated composition part 1) satisfies all the following conditions:

(1) pH is from 2.0 to 3.5,
(2) a specific gravity is 1.130 or more,
(3) the bleaching agent comprises an iron(III) complex salt of an aminopolycarboxylic acid,
(4) a concentration of the bleaching agent is from 0.5 to 1.0 mole/L, and
(5) a content of an aminopolycarboxylic acid having not been complexed is from 0.1 to 3% by mole based on the bleaching agent.

(2) The concentrated blix solution composition for a silver halide color photographic photosensitive material as described in the item (1), wherein the concentrated composition part 1) contains at least one of a monobasic acid and a dibasic acid, which have pKa of from 2 to 5, in an amount of from 0.2 to 1.0 mole/L.

(3) The concentrated blix solution composition for a silver halide color photographic photosensitive material as described in the items (1) or (2), wherein the concentrated composition part 1) contains a dibasic acid having pKa of from 2 to 5 in an amount of from 0.2 to 1.0 mole/L.

(4) The concentrated blix solution composition for a silver halide color photographic photosensitive material as described in any one of the items (1) to (3), wherein the concentrated composition part 1) is housed in a container having an oxygen permeation rate of 4 mL/24 hrs or more.

(5) The concentrated blix solution composition for a silver halide color photographic photosensitive material as described in any one of the items (1) to (4) wherein the concentrated composition part 1) satisfies all the following conditions:

(1) pH is from 2.2 to 3.3, (2) a specific gravity is 1.150 or more, (3) the bleaching agent comprises an iron(III) complex salt of an aminopolycarboxylic acid, (4) a concentration of the bleaching agent is from 0.6 to 0.9 mole/L, and (5) a content of an aminopolycarboxylic acid having not been complexed is from 0.2 to 2.7% by mole based on the bleaching agent.

(6) A process for processing a silver halide color photographic photosensitive material, comprising processing the photosensitive material by using the concentrated blix solution composition as described in any one of the items (1) to (5).

(7) The process for processing a silver halide color photographic photosensitive material as described in the item (6), wherein a blix processing time is 30 seconds or less.

(8) The process for processing a silver halide color photographic photosensitive material as described in the item (6) or (7), wherein a total replenishing amount of a replenisher for the blix solution is from 20 to 50 mL per 1 $m^2$ of the photosensitive material.

(9) The process for processing a silver halide color photographic photosensitive material as described in anyone of the items (6) to (8), wherein the concentrated composition part 1) and the concentrated composition part 2) are mixed to form the blix solution.

(10) The process for processing a silver halide color photographic photosensitive material as described in any one of the items (6) to (9), wherein the concentration of the bleaching agent in the blix solution prepared from the concentrated composition part 1) is from 0.01 to 1.0 mole/L.

(11) The process for processing a silver halide color photographic photosensitive material as described in any one of the items (6) to (10), wherein the concentration of the fixing agent in the blix solution prepared from the concentrated composition part 2) is from 0.3 to 3 mole/L.

(12) The process for processing a silver halide color photographic photosensitive material as described in any one of the items (6) to (11), wherein the blix solution has a pH of 3 to 8.

The invention is based on the fact that the dissolution natures of the respective constitutional components are controlled under the following mutual relationship. That is, a bleaching agent processing composition containing an iron(III) complex salt of an aminopolycarboxylic acid suffers restriction in increasing concentration from the solubility of the iron(III) complex salt of an aminopolycarboxylic acid, but it can be dissolved and prevented from deposition at a high concentration of 0.5 mole/L when the pH value is 3.5 or less. In the case where the pH value is decreased, on the other hand, a free aminopolycarboxylic acid is insolubilized, but in the case where the concentration thereof is adjusted to 3% by mole or less based on the iron(III) complex salt of an aminopolycarboxylic acid, deposition can be prevented even when the pH value is decreased to 2.0. Furthermore, even when the amount of the free aminopolycarboxylic acid is as small as 0.1% by mole based on the amount of the total aminopolycarboxylic acid, generation and precipitation and deposition of a ferrous compound caused by decomposition of the iron(III) complex salt of an aminopolycarboxylic acid at a high temperature can be prevented. Therefore, in such conditions that the pH value is from 2.0 to 3.5, and the concentration of the free aminopolycarboxylic acid is from 0.1 to 3% by mole based on the iron(III) complex salt of an aminopolycarboxylic acid, respective the constitutional components can be stably present even when the concentration of the iron(III) complex salt of an aminopolycarboxylic acid as a bleaching agent is from 0.5 to 1.0 mole/L with a specific gravity of 1.130 or more. The presence of the region of stability with respect to the constitutional components is a matter that is newly found by the inventors and has not been referred in the conventional bleaching agent compositions.

Therefore, one of the characteristic features of the invention resides in that it has been found that there is such a region where the respective constitutional component can be stably present even when the bleaching agent is enriched, and the bleaching agent part is constituted within the region.

According to the formulation of the bleaching agent within the specific region, the bleaching agent part can be enriched, whereby such an expedited and/or low-replenishing processing as a low-replenishing processing of from 20 to 50 mL/$m^2$ and/or a shortened blix processing of 30 seconds or less can be realized while maintaining the finish quality and preventing deposition and deterioration of the processing solution.

The invention will be described in more detail below.

DETAILED DESCRIPTION OF THE INVENTION

The concentrated blix solution composition of the invention will be described.

The concentrated blix solution composition is constituted with a bleaching agent part and a fixing agent part. In the bleaching agent part, (1) pH is from 2.0 to 3.5, (2) a specific gravity is 1.130 or more, (3) the bleaching agent contains an iron(III) complex salt of an aminopolycarboxylic acid, (4) a concentration of the bleaching agent is from 0.5 to 1.0 mole/L, and (5) an aminopolycarboxylic acid having not been complexed is contained in an amount of from 0.1 to 3% by mole based on the bleaching agent. It is preferred that the pH value is from 2.2 to 3.3, the specific gravity is 1.150 or more, the concentration of the iron(III) complex salt of an aminopolycarboxylic acid is from 0.6 to 0.9 mole/L, and an aminopolycarboxylic acid having not been complexed is contained in an amount of from 0.2 to 2.7% by mole based on the bleaching agent.

The processing composition is stable without precipitation and deposition when the concentration of the iron(III) complex salt of an aminopolycarboxylic acid in the bleaching agent part does not exceed 1.0 mole/L, and the expedited processing and the low replenishment that meet the objects of the invention are ensured when it is 0.5 mole/L or more.

Furthermore, in the case where the concentration of the iron(III) complex salt of an aminopolycarboxylic acid is in the forgoing range, all the constitutional components including the iron(III) complex salt are stably present even with a specific gravity of 1.13 or more, and therefore, another necessary constitutional component may be added. However, the specific gravity is preferably 1.9 or less from the standpoint of restriction in solubility.

Other known bleaching agents may be used as the bleaching agent in addition to the iron(III) complex salt of an aminopolycarboxylic acid. Examples of the bleaching agent that can be used in combination include an iron(III) complex salt of an organic acid, such as citric acid, tartaric acid and malic acid, a persulfate and hydrogen peroxide.

Preferred examples of the iron(III) complex salt of an aminopolycarboxylic acid include iron(III) complex salts of aminopolycarboxylic acids, examples of which include ethylenediamine succinic acid (SS isomer), N-(2-carboyxylateethyl)-L-aspartic acid, β-alanine diacetic acid and methylimino diacetic acid, and further include ethylenediamine tetraacetic acid, diethylenetriamine pentaacetic acid, 1,3-diaminopropane tetraacetic acid, propylenediamine tetraacetic acid, nitrilo triacetic acid, cyclohexanediamine tetraacetic acid, imino diacetic acid and glycol ether diamine tetraacetic acid. These compounds may be any of a sodium salt, a potassium salt, a lithium salt and an ammonium salt. Among these compounds, iron(III) salts of ethylenediamine succinic acid (SS isomer), N-(2-carboyxylateethyl)-L-aspartic acid, β-alanine diacetic acid, ethylenediamine tetraacetic acid, 1,3-diaminopropane tetraacetic acid and methylimino diacetic acid are preferred owing to the good photographic properties thereof. These iron(III) complex salts may be used in the form of a complex salt, or in alternative, the iron(III) complex salt may be formed in a solution by using a ferric salt, such as ferric sulfate, ferric chloride, ferric nitrate, ammonium ferric sulfate and ferric phosphate, with a chelating agent, such as an aminopolycarboxylic acid. The chelating agent is used excessively in an amount more than that for forming the iron(III) complex salt.

The concentration of the bleaching agent in the bleaching agent part is specified in such a manner that the concentration of the bleaching agent in the processing solution prepared from the processing composition is from 0.01 to 1.0 mole/L, preferably from 0.03 to 0.80 mole/L, more preferably from 0.05 to 0.70 mole/L, and further preferably from 0.07 to 0.50 mole/L.

The bleaching agent part preferably contains various kinds of a known organic acid (such as acetic acid, lactic acid, glycolic acid, succinic acid, maleic acid, malonic acid, citric acid, sulfosuccinic acid, citric acid, tartaric acid, glutaric acid and lactic acid), various kinds of a known organic base (such as imidazole and dimethylimidazole), a compound represented by the general formula (A-a) described in JP-A-9-211819, such as 2-picolinic acid, and a compound represented by the general formula (B-b) described in the same publication, such as kojic acid. The addition amount of the compound is preferably such an amount that provides a concentration per 1 L of the processing solution thus prepared of from 0.05 to 3.0 mole, and more preferably from 0.2 to 1.0 mole. The organic acid is preferably a monobasic acid or a dibasic acid, and is more preferably a dibasic acid since it is excellent in prevention of deposition and causes no bleaching delay.

The fixing agent part, which constitutes the blix processing composition in combination with the bleaching agent part, may contain one of or a combination of two or more selected from known fixing agents, for example, a thiosulfate, such as sodium thiosulfate and ammonium thiosulfate, a thiocyanate, such as sodium thiocyanate and ammonium thiocyanate, ethylenebisthioglycolic acid, a thioether compound, such as 3,6-dithia-1,8-octanedithiol, and a water soluble silver halide resolvent, such as a thiourea compound. The special blix solution described in JP-A-55-155354 containing a combination of a bleaching agent and a large amount of halide, such as potassium iodide may also be used. In the invention, a thiosulfate, particularly ammonium thiosulfate, is preferably used. The concentration of the fixing agent in the fixing agent part is preferably designed to provide a concentration per 1 L of the blix solution thus prepared of from 0.3 to 3 mole, and more preferably from 0.5 to 2.0 mole.

The fixing agent part preferably contains, as a preservative, a sulfite ion generating compound, such as a sulfite (such as sodium sulfite, potassium sulfite and ammonium sulfite), a bisulfite (such as ammonium bisulfite, sodium bisulfite and potassium bisulfite) and a metabisulfite (such as potassium metabisulfite, sodium metabisulfite and ammonium metabisulfite), and an arylsulfinic acid, such as p-toluenesulfinic acid and m-carboxybenzenesulfinic acid. These compounds are preferably contained in an amount of about from 0.02 to 1.0 mole/L in terms of a concentration of a sulfite ion or a sulfinate ion in the processing solution thus prepared.

As a preservative in addition to the foregoing compounds, ascorbic acid, a carbonylbisulfurous acid adduct and a carbonyl compound may also be added.

The blix solution prepared by mixing the bleaching agent part and the fixing agent part with a certain amount of water added depending on necessity will be described below, and constitutional components for the blix solution that may be contained in either the bleaching agent part or the fixing agent part will also described herein.

The pH region upon dissolving the blix processing composition is preferably from 3 to 8, and more preferably from 4 to 8. When the pH value is less than the range, deterioration of the solution and formation of leuco compounds of a cyan dye are accelerated while the desilvering property is improved. When the pH value is higher than the range, on the other hand, desilvering is delayed, and stain is liable to occur.

In order to adjust the pH value, the fixing agent part may be added, depending on necessity, with an alkali, such as potassium hydroxide, sodium hydroxide, lithium hydroxide, lithium carbonate, sodium carbonate and potassium carbonate, or an acidic or alkaline buffer agent.

Other various kinds of a fluorescent whitening agent, a defoaming agent, a surface active agent and polyvinylpirrolidone may be added to one or both of the parts of the blix processing composition.

The blix processing composition is generally supplied in the form housed in a container. The container for the parts of the blix processing composition preferably has a certain extent of an oxygen permeation rate from the standpoint of the time-lapse stability of the composition, which is different in concept from other containers for processing agents. In order to ensure the oxygen permeability, it is not necessary to select a material having oxygen permeability for the container, but it is sufficient that the airtightness of the container is released by the structure of the opening of the container. The oxygen permeability is preferably such an extent that provides an oxygen permeation amount of 4 mL or more per day, and preferably 13 mL or less in view of the restriction in thickness of the container for maintaining the shape of the container.

Examples of the preferred container used in a typical housing form of a bleaching agent include such a container that is produced with high density polyethylene (hereinafter, referred to as HDPE) having a density of from 0.941 to 0.969 and a melt index of from 0.3 to 5.0 g/10 min as a sole constitutional resin. The density is more preferably from 0.951 to 0.969, and further preferably from 0.955 to 0.965. The melt index is more preferably from 0.3 to 5.0, and further preferably from 0.3 to 4.0. The melt index herein is such a value that is measured according to the method defined in ASTM D1238 at a temperature of 190° C. and a load of 2.16 kg. The container preferably has a thickness of from 500 to 1,500 μm. However, the container for the processing agent used in the invention is not limited to the HDPE container, which is suitable for mounting in a developing machine, but it may be those containers that are produced with a general purpose container material other than HDPE, such as polyethylene terephthalate (PET), polyvinyl chloride (PVC) and low density polyethylene (LDPE), or HDPE having a density and/or a melt index outside the foregoing ranges.

Such a housing form is also preferred that is generally referred to as a cubitainer formed with a reinforcing corrugated fiberboard having a resin container with a dimension adapted to the inner dimension thereof inserted therein.

As the container for the processing agent, containers described later may also be used, and they preferably have such a form that ensures the oxygen permeation rate specified in the foregoing.

A color development process using the blix processing composition of the invention will be described below.

A color development process, to which the blix processing composition of the invention is applied, contains a color developing step, a desilvering step, a water washing or stabilizing step and a drying step, and an auxiliary step, such as a rinsing step, an intermediate water washing step and a neutralizing step, may be inserted among the steps. The desilvering step is carried out as a one-step process with a blix solution. In addition to a stabilizing step instead of the water washing step, an image stabilizing step for stabilizing an image may be inserted between the water washing or stabilizing step and the drying step.

According to the constitution of the blix processing composition of the invention, the replenishing amount of the blix solution can be considerably lowered, and it is preferably from 20 to 50 mL, more preferably from 25 to 45 mL, and most preferably from 25 to 40 mL, per 1 $m^2$ of the photosensitive material. The replenishing amount of the blix solution is preferably divided into the bleaching agent part and the fixing agent part. In this case, the replenishing amount for the blix solution designates the total amount of the replenishing amounts for the bleaching agent part and the fixing agent part. The replenishing amount for the rinsing solution (water for washing and/or the stabilizing solution) is preferably from 50 to 200 mL in total rinsing solution per 1 $m^2$ of the photosensitive material.

The color developing time (i.e., the period of time, over which the color developing step is carried out) is preferably 45 seconds or less, more preferably 30 seconds or less, further preferably 28 seconds or less, particularly preferably from 6 to 25 seconds, and most preferably from 6 to 20 seconds. Similarly, the blix time (i.e., the period of time, over which the blix step is carried out) is preferably 45 seconds or less, more preferably 30 seconds or less, further preferably from 6 to 25 seconds, and particularly preferably 6 to 20 seconds. The rinsing (water washing or stabilizing) time (i.e., the period of time, over which the rinsing step is carried out) is preferably 90 seconds or less, more preferably 30 seconds or less, and further preferably from 6 to 30 seconds.

The color developing time means a period of time from the entrance of the photosensitive material into the color developing solution until the entrance into the blix solution as the next processing step. For example, in the case where the processing is carried out by an automatic developing machine, the color developing time means the total of the period where the photosensitive material is immersed in the color developing solution (i.e., the so-called submerged time) and the period where the photosensitive material leaves the color developing solution and is transferred in the air toward the blix solution as the next processing step (i.e., the so-called aerial time). Similarly, the blix time means a period of time from the entrance of the photosensitive material into the blix solution until the entrance into the next water washing or stabilizing bath. The rinsing (water washing or stabilizing) time means a period of time from the entrance of the photosensitive material into the rinsing solution (water washing or stabilizing solution) until the time, during which it is in the solution (i.e., the so-called submerged time) toward the drying step.

The temperatures of the processing solution in the color developing step, the blix step and the rinsing step are generally from 30 to 40° C., and in the expedited process, it is preferably from 38 to 60° C., and more preferably from 40 to 50° C.

The amount of the rinsing solution may be set within a wide range depending on various conditions, such as the characteristics of the photosensitive material (e.g., the materials used, such as a coupler), the purpose thereof, the temperature of the rinsing solution (washing water), and the number of the rinsing solutions (i.e., the number of steps of the water washing tanks). Among these, the relationship between the number of rinsing solution tanks (water washing tanks) and the amount of water in the multistage counter current system can be obtained by the method described in *Journal of the Society of Motion Picture and Television Engineers*, vol. 64, p. 248 to 253 (May of 1955).

In general, the number of steps in the multistage counter current system is preferably from 3 to 15, and particularly preferably from 3 to 10.

According to the multistage counter current system, the amount of the rinsing solution can be significantly reduced, but the increase of the residence time of water in the tank brings about such a problem as breeding of bacteria, which causes contamination of the photosensitive material by attaching floating matters thus formed. Therefore, a rinsing solution containing an anti-bacterial and anti-fungal agent described later is preferably used as a countermeasure therefor.

The silver halide color photographic photosensitive material having been subjected to the development process is then subjected to a post treatment, such as a drying step. In the drying step, it is possible that the water content is absorbed with a squeezing roller or cloth immediately after completing the development process (rinsing step) in order to reduce the carry-over amount of water to the image film of the silver halide color photographic photosensitive material. It is also possible that the drying operation is expedited by increasing the strength of the drying air flow by increasing the temperature and changing the shape of the nozzle. Furthermore, the drying operation can be expedited by adjusting the incident angle of the drying air flow onto the photosensitive material and by changing the removing method of the discharging air flow as described in JP-A-3-157650.

Constitutional components of other processing compositions used in the color developing step along with the blix processing solution and processing solutions produced therefrom will be described.

The processing compositions, including the blix processing composition, are formed into a mother solution (tank solution) or a replenishing solution by mixing with a solvent, such as water, at a prescribed proportion upon use, and in this description, both the tank solution and the replenishing solution are commonly referred to as a used solution unless there is particular significance in distinguishing the solutions.

The color development processing composition and the color developing solution contain a color developing agent.

Preferred examples of the color developing agent include an aromatic primary amine color developing agent, particularly a p-phenylenediamine derivative. Representative examples thereof will be described below, but the invention is not construed as being limited thereto.

(1) N,N-diethyl-p-phenylenediamine
(2) 4-amino-3-methyl-N,N-diethylaniline
(3) 4-amino-N-(β-hydroxyethyl)-N-methylaniline
(4) 4-amino-N-ethyl-N-(β-hydroxyethyl)aniline
(5) 4-amino-3-methyl-N-ethyl-N-(β-hydroxyethyl)aniline
(6) 4-amino-3-methyl-N-ethyl-N-(3-hydroxypropyl)aniline
(7) 4-amino-3-methyl-N-ethyl-N-(4-hydroxybutyl)aniline
(8) 4-amino-3-methyl-N-ethyl-N-(β-methanesulfonamideethyl)aniline
(9) 4-amino-N,N-diethyl-3-(β-hydroxyethyl)aniline
(10) 4-amino-3-methyl-N-ethyl-N-(β-methoxyethyl)aniline
(11) 4-amino-3-methyl-N-(β-ethoxyethyl)-N-ethylaniline
(12) 4-amino-3-methyl-N-(3-carbamoylpropyl-N-n-propyl) aniline
(13) 4-amino-N-(4-carbamoylbutyl-N-n-propyl-3-methyl) aniline
(15) N-(4-amino-3-methylphenyl)-3-hydroxypyrrolidine
(16) N-(4-amino-3-methylphenyl)-3-(hydroxymethyl) pyrrolidine
(17) N-(4-amino-3-methylphenyl)-3-pyrrolidinecarboxyamide Among the foregoing p-phenylenediamine derivatives, the example compounds (5), (6), (7), (8) and (12) are particularly preferred, and the compounds (5) and (8) are preferred among these. The p-phenylenediamine derivatives are generally in the form of a salt, such as a sulfate, a hydrochloride, a sulfite, a naphthalenedisulfonate and a p-toluenesulfonate, in the state of a solid material.

The content of the aromatic primary amine developing agent in the processing agent in terms of the concentration of the developing agent in the used solution is generally from 2 to 200 mmole, preferably from 6 to 100 mmole, and more preferably from 10 to 40 mmole, per 1 L of the developing solution.

Furthermore, a small amount of a hydroxylamine may be contained. In the case where a hydroxylamine (which is generally used in the form of a hydrochloride or a sulfate, but the reference to a salt form is omitted herein) is contained, it functions as a preservative as similar to a sulfite ion, but may affect the photographic characteristics due to the silver developing activity of the hydroxylamine itself. Therefore, the addition amount thereof is necessarily low.

An organic preservative may be added as a preservative to the color developing agent in addition to the hydroxylamine and the sulfite ion. The organic preservative totally designates organic compounds that reduces, upon addition to the processing solution for the photosensitive material, the deterioration rate of the aromatic primary amine color developing agent. That is, it is an organic compound having such a function that prevents air oxidation of the color developing agent. Particularly useful organic preservatives among these are the hydroxylamine derivative, a hydroxamic acid compound, a hydrazide compound, a phenol compound, an α-hydroxyketone compound, an α-aminoketone compound, a saccharide, a monoamine compound, a diamine compound, a polyamine compound, a quaternary ammonium salt compound, a nitroxy radical compound, an alcohol compound, an oxime compound, a diamide compound and a condensed cyclic amine compound. These are described in JP-A-63-4235, JP-A-63-30845, JP-A-63-21647, JP-A-63-44655, JP-A-63-53551, JP-A-63-43140, JP-A-63-56654, JP-A-63-58346, JP-A-63-43138, JP-A-63-146041, JP-A-63-44657, JP-A-63-44656, U.S. Pat. Nos. 3,615,503, 2,494,903, JP-A-52-143020 and JP-B-48-30496.

Other examples of the preservative that can be contained depending on necessity include various kinds of metallic compounds described in JP-A-57-44148 and JP-A-57-53749, a salicylic acid compound described in JP-A-59-180588, an alkanolamine compound described in JP-A-54-3532, a polyethyelneimine compound described in JP-A-56-94349, and an aromatic polyhydroxyl compound described in U.S. Pat. No. 3,756,544. In particular, for example, an alkanol amine compound, such as trietanolamine and triisopropanolamine, a substituted or unsubstituted dialkylhydroxylamine, such as disulfoethylhydroxylamine and diethylhydroxylamine, and an aromatic polyhydroxyl compound may be added.

Among the forgoing organic preservatives, the hydroxylamine derivative is described in detail in JP-A-1-97953, JP-A-1-186939, JP-A-1-186940 and JP-A-1-187557. In particular, there are some cases where the addition of the hydroxylamine derivative along with an amine compound is effective for improving the stability of the color developing solution and for improving the stability upon continuous processing.

Examples of the amine compound include a cyclic amine described in JP-A-63-239447, an amine compound described in JP-A-63-128340, and amine compounds described in JP-A-1-186939 and JP-A-1-187557. The content of the preservative in the processing agent in terms of the concentration in the used solution is generally from 1 to 200 mmole, and preferably from 10 to 100 mmole, per 1 L of the developing solution, while it varies depending on the species of the preservative.

In the color developing agent, for example a developing agent for color paper, a chloride ion may be added depending on necessity. A color developing solution (particularly, a developing agent for a color print material) often contains a chloride ion in an amount of from $3.5\times10^{-2}$ to $1.5\times10^{-1}$ mole/L. A chloride ion is generally released as a by-product of development, and thus there are often the case where it may not added to the developing agent for replenishment. A developing agent for a photosensitive material for picturizing may contain no chloride ion.

The content of a bromide ion in the color developing solution is preferably about from $1\times10^{-3}$ to $5\times10^{-3}$ mole/L for processing a material for picturizing and $1.0\times10^{-3}$ mole/L or less for processing a printing material. However, there are often the cases where it may not be added to the color developing agent as similar to the case of a chloride ion. In some cases, a bromide ion is added to the processing agent depending on necessity to make the bromide ion concentration within the foregoing range.

In the case where the photosensitive material to be developed is that obtained with a silver iodobromide emulsion, such as a color negative film and a color reversal film, the same situation can be applied to an iodide ion, but because an iodide ion is released from the photosensitive material to make an iodide ion concentration of from 0.5 to 10 mg per 1 L of the developing solution, it is general that no iodide ion is contained in the processing agent for replenishment.

In the case where a halide is used as an addition component of the developing agent or the replenisher therefor, examples of the chloride ion supplying substance include sodium chloride, potassium chloride, ammonium chloride, lithium chloride, nickel chloride, magnesium chloride, manganese chloride and calcium chloride, and among these, sodium chloride and potassium chloride are preferably used.

Examples of the bromide ion supplying substance include sodium bromide, potassium bromide, ammonium bromide, lithium bromide, calcium bromide, magnesium bromide, manganese bromide, nickel bromide, cerium bromide and thallium bromide, and among these, potassium bromide and sodium bromide are preferably used.

As the iodide ion supplying substance, sodium iodide and potassium iodide are used.

In the invention, the developing solution preferably has pH of from 9.0 to 13.5, and the replenisher therefor preferably has pH of from 9.0 to 13.5. Therefore, the developing agent and the replenisher therefor may contain an alkaline agent or a buffer agent, and depending on necessity, an acidic agent, for maintaining the pH value.

In order to retain the pH value upon preparing the processing solution, it is preferred to use various kinds of buffer agents. Examples of the buffer agent include a carbonate, a phosphate, a borate, a tetraborate, a hydroxybenzoate, a glycyl salt, an N,N-dimethylglycyl salt, a leucine salt, a norleucine salt, a guanine salt, a 3,4-dihydroxyphenylalanine salt, an alanine salt, an aminobutyrate, a 2-amino-2-methyl-1,3-propane diol salt, a valine salt, a proline salt, a trishydroxyaminomethane salt and a lysin salt. In particular, a carbonate, a phosphate, a tetraborate and a hydroxybenzoate are particularly preferably used because they have such advantages that they are excellent in buffering capability in a high pH region of pH 9.0 or higher, cause no adverse affect on photographic characteristics (such as fogging) upon adding to the color developing solution, and are inexpensive.

Specific examples of the buffer agent include sodium carbonate, potassium carbonate, sodium bicarbonate, potassium bicarbonate, trisodium phosphate, tripotassium phosphate, disodium phosphate, dipotassium phosphate, sodium borate, potassium borate, sodium tetraborate (borax), potassium tetraborate, sodium o-hydroxybenzoate (sodium salicylate), potassium o-hydroxybenzoate, sodium 5-sulfo-2-hydroxybenzoate (sodium 5-sulfosalicylate) and potassium 5-sulfo-2-hydroxybenzoate (potassium 5-sulfosalicylate). However, the invention is not construed as being limited to these compounds.

The buffer agent is not such a component that is reacted and consumed, and therefore, the addition amount thereof is determined in such a manner that the concentration thereof is from 0.01 to 2 mole, and preferably from 0.1 to 0.5 mole, per 1 L in both the developing solution and the replenisher therefor produced from the processing agent.

The color developing agent may also contain other color developing solution components, such as various kinds of chelating agents functioning as a precipitation preventing agent for calcium and magnesium or a stability improving agent for the color developing solution. Examples thereof include nitrilotriacetic acid, diethylenetriamine pentaacetic acid, ethylenediamine tetraacetic acid, N,N,N-trimethylenesulfonic acid, ethylenediamine N,N,N',N'-tetramethylenesulfonic acid, trans-cyclohexanediamine tetraacetic acid, 1,2-diaminopropane tetraacetic acid, glycol etherdiamine tetraacetic acid, ethylenediamine o-hydroxyphenylacetic acid, ethylenediamine succinic acid (SS isomer), N-(2-carboxylateethyl)-L-aspartic acid, β-alanine diacetic acid, 2-phosphonobutane 1,2,4-tricarboxylic acid, 1-hydroxyethylidene 1,1-diphosphonic acid, N,N'-bis(2-hydroxybenzyl)ethylenediamine N,N'-diacetic acid and 1,2-dihydroxybenzene 4,6-disulfonic acid.

These chelating agents may be used in combination of two or more thereof.

The amount of the chelating agents may be such an amount that is sufficient for blocking metallic ions in the color developing solution thus prepared. For example, it is added in an amount of from 0.1 to 10 g per 1 L.

The color developing solution of the invention may contain an arbitrary development accelerating agent depending on necessity. Examples of the development accelerating agent that can be added include thioether compounds described in JP-B-37-16088, JP-B-37-5987, JP-B-38-7826, JP-B-44-12380, JP-B-45-9019 and U.S. Pat. No. 3,813,247, p-phenylenediamine compounds described in JP-A-52-49829 and JP-A-50-15554, quaternary ammonium salt compounds described in JP-A-50-137726, JP-B-44-30074, JP-A-56-156826 and JP-A-52-43429, amine compounds described in U.S. Pat. No. 2,494,903, No. 3,128,182, No. 4,230,796, No. 3,253,919, JP-B-41-11431, U.S. Pat. No. 2,482,546, No. 2,596,926 and No. 3,582,346, polyalkylene oxide described in JP-B-37-16088, JP-B-42-25201, U.S. Pat. No. 3,128,183, JP-B-41-11431, JP-B-42-23883 and U.S. Pat. No. 3,532,501, and a 1-phenyl-3-pyrazoline compound or an imidazole compound. The addition amount thereof is determined in such a manner that the concentration thereof in the developing solution and the replenisher therefor prepared from the processing agent is from 0.001 to 0.2 mole, and preferably from 0.01 to 0.05 mole, per 1 L.

The color developing agent in the invention may contain an arbitrary antifoggant in addition to the foregoing halogenide ion depending on necessity. Examples of the organic antifoggant include a nitrogen-containing heterocyclic compound, such as benzotriazole, 6-nitrobenzimidazole, 5-nitroisoindazole, 5-methylbenzotriazole, 5-nitrobenzotriazole, 5-chlorobenzotriazole, 2-thiazolylbenzimidazole, 2-thiazolylmethylbenzimidazole, indazole, hydroxyazaindrizine and adenine.

The color developing agent may contain various kinds of surface active agents, such as an alkyl sulfonate, an aryl sulfonate, an aliphatic carboxylic acid and an aromatic carboxylic acid, depending on necessity. The addition amount thereof is determined in such a manner that the concentration thereof in the developing solution and the replenisher therefor prepared from the processing agent is from 0.001 to 0.2 mole, and preferably from 0.001 to 0.05 mole, per 1 L.

A fluorescent whitening agent may be used in the invention depending on necessity. Preferred examples of the fluorescent whitening agent include bis(triazinylamino) stilbene sulfonic acid compound. Examples of the bis (triazinylamino)stilbene sulfonic acid compound include known or commercially available diaminostilbene series whitening agent. Examples of the known bis(triazinylamino) stilbene sulfonic acid compound include compounds described in JP-A-6-329936, JP-A-7-140625 and JP-A-10-140849. The commercially available compounds are described, for example, in *Senshoku Note* (Dyeing Note), 9th Ed. (published by Senshoku-sha Co., Ltd.), p. 165 to 168, and among the compound described therein, Blankophor BSU liq. and Hakkol BRK are preferred.

A stabilizing bath for substituting water washing or an image stabilizing bath is often used after completing the fixation or the blix. Since these baths are of a low concentration, the stabilizing agent do not have large efficacy, and the stabilizing agent may be used depending on necessity. The treating agent for the stabilizing bath is particularly usefully employed in a method of decreasing calcium and magnesium described in JP-A-62-288838. Furthermore, an isothiazolone compound and a thiabendazole compound described in JP-A-57-8542, a chlorine bactericide, such as sodium chlorinated isocyanurate described in JP-A-61-120145, benzotriazole described in JP-A-61-267761, a copper ion, and bactericides described in Bokin Bobai no Kagaku (Antibacterial and Anti fungal Chemistry), by H. Horiguchi, Sankyo Shuppan Co., Ltd. (1986), Biseibutu no Mekkin, Sakkin, Bobai Gijutu (Sterilization and Disinfect of Microorganisms and Antifungal Techniques), edited by Eisei Gijutukai, Kogyogijutukai Co., Ltd. (1982) and Bokin Bobai-zai Jiten (Antibacterial and Antifungal Agent Encyclopedia) edited by Society for Antibacterial and Antifungal Agents, Japan (1986) may also be used.

In order to prevent degradation of a colorant and formation of stain by inactivating the remaining magenta coupler, an aldehyde compound, such as formaldehyde, acetaldehyde and pyruvic aldehyde, a methylol compound and hexamethylene tetramine described in U.S. Pat. No. 4,786,583, a hexahydrotriazine compound described in JP-A-2-153348, a bisulfurous acid adduct of formaldehyde described in U.S. Pat. No. 4,921,779, and an azolylmethylamine compound described in EP-A-504,609 and EP-A-519,190 may also be added. Furthermore, a surface active agent may be used as a draining agent, and a chelating agent, such as EDTA, may be used as a hard water softening agent.

The development processing method using the concentrated blix solution composition of the invention has been described. A development processing apparatus for carrying out the development process will be then described.

The development processing method of the invention is carried out on an automatic developing machine. An automatic developing machine that can be preferably used in the invention will be described below.

In the invention, the conveying linear velocity of the automatic developing machine is preferably 100 mm/sec or less. It is more preferably from 27.8 to 80 mm/sec, and particularly preferably from 27.8 to 50 mm/sec.

The conveying system of an automatic developing machine for color paper includes such a system that color paper cut into a final size is subjected to the developing process (sheet type conveying system) and such a system that color paper in a long sheet form is subjected to the developing process and then cut into a final size after the process (cinema type conveying system). The cinema type conveying system suffers loss of a photosensitive material of about 2 mm between images, and the sheet type conveying system is preferred.

The processing solutions used in the invention preferably has an area in contact with air (i.e., an opening area) in the processing baths and the replenisher tanks as small as possible. For example, the opening ratio, which is a value obtained by dividing the opening area ($cm^2$) by the volume of the solution in the bath ($cm^3$), is preferably 0.01 $cm^{-1}$ or less, and more preferably 0.005 $cm^{-1}$ or less, and most preferably 0.001 $cm^{-1}$ or less.

In order to reduce the area in contact with air, it is preferred to provide a solid or liquid means for preventing the solution from contacting with air floating on the solution surface in the processing baths and the replenisher tanks.

Specifically, a method of floating a plastic floater on the solution surface and a method of covering the solution with a liquid that is not miscible with or is not reacted with the processing solution are preferred. Examples of the liquid include liquid paraffin and a liquid saturated hydrocarbon.

In order to expedite the process in the invention, the aerial time, during which the photosensitive material moves between the processing solutions, i.e., the crossover time, is preferably as short as possible, and it is preferably 10 seconds or less, more preferably 7 seconds or less, and further preferably 5 seconds or less.

In order to reduce the crossover time and to prevent mixing of the processing solutions, it is preferred to use a crossover rack structure having a mixing preventing plate equipped thereto.

As a method for completely eliminating the crossover time, it is particularly preferred to use the submerged conveying structure by using a blade described in JP-A-2002-55422. In this method, a plate is provided between the processing baths to prevent leakage of the solutions, to which the photosensitive material passed to eliminate the crossover time.

It is particularly preferred that a liquid circulation structure for directing the liquid circulation flow downward is employed, and a pleated filter formed with a porous material is provided on the circulation system.

The respective processing solution used in the invention are preferably subjected to so-called evaporation compensation, i.e., supplied with water in an amount equivalent to the evaporated amount from the processing solution.

The specific method for carrying out the supply of water is not particularly limited, and such a method described in JP-A-1-254959 and JP-A-1-254960 is preferred in that a monitor bath is provided separately from the blix bath to obtain an evaporated amount of water in the monitor bath, and the evaporated amount of water in the blix bath is obtained from the evaporated amount of water in the monitor bath, so as to supply water to the blix bath in an amount relative to the evaporated amount, and such an evaporation compensation method is also preferred that uses a liquid level sensor or an overflow sensor. The most preferred evaporation compensation method is to supply water in an predicted evaporation amount, in which water is supplied in such an amount that is calculated with a coefficient obtained based on the information including the operation time, the suspended time and the temperature adjusting time of the automatic developing machine, as described in *JIII Journal of Technical Disclosure Monthly*, No. 94-49925, page 1, right column, line 26 to page 3, left column, line 28.

It is also necessary to contrive to reduce the evaporated amount, and it is desired to reduce the opening area and to adjust the airflow amount of a discharge fan. For example, as the preferred opening ratio for the color developing solution has been described in the foregoing, it is preferred that the opening areas for the other processing solutions are similarly reduced.

As a measure for reducing the evaporated amount, a method of retaining the humidity of the upper space in the processing bath to 80% RH or more as described in JP-A-6-110171 is preferred, and it is particularly to use an evaporation preventing rack and a roller automatic washing mechanism described in FIGS. 1 and 2 of the publication. A discharge fan is generally provided for preventing dropwise condensation upon adjusting the temperature, and the discharge amount is preferably from 0.1 to 1 $m^3$/min, and particularly preferably from 0.2 to 0.4 $m^3$/min.

The drying condition for the photosensitive material also influences evaporation of the processing solution. The drying system preferably uses a ceramic hot air heater, and the air flow amount to be supplied is preferably from 4 to 20 $m^3$/min, and particularly preferably from 6 to 10 $m^3$/min.

The overheating protecting thermostat of the ceramic hot air heater is preferably operated by heat transmission, and the mounted position thereof is preferably the windward side or the leeward side via a heat dissipation fin or a heat transmission part. The drying temperature is preferably adjusted depending on the water content of the photosensitive material to be processed, and it is preferably from 45 to 55° C. for an APS format film or a 35 mm film and is preferably from 55 to 65° C. for a brownie film. The drying time is preferably from 5 seconds to 2 minutes, and particularly preferably from 5 to 60 seconds.

A replenishing pump is used for replenishing the processing solution, and a bellows type replenishing pump is preferred therefor. It is effective for improving the replenishment accuracy that the diameter of the liquid transporting tube toward the replenishing nozzle is reduced to prevent the adverse current upon suspending the pump. The inner diameter thereof is preferably from 1 to 8 mm, and particularly preferably from 2 to 5 mm.

Various kinds of materials are used for the parts of the automatic developing machine, and preferred examples of the materials will be described below.

The tank material of the processing baths and the temperature adjusting bath is preferably a modified PPO (modified polyphenylene oxide) and a modified PPE (modified polyphenylene ether). Examples of the modified PPO include Noryl, a trade name, produced by Nippon GE Plastics Co., Ltd., and examples of the modified PPE include Xyron, a trade name, produced by Asahi Kasei Corp. and Iupiace, a trade name, produced by Mitsubishi Gas Chemical Co., Inc. These materials are preferred for the area that maybe in contact with the processing solution, such as a processing rack and a crossover part.

The material of the roller in the processing part is preferably such a resin as PVC (polyvinyl chloride), PP (polypropylene), PE (polyethylene) and TPX (polymethylpentene). These materials may also be used in other parts in contact with the processing solution. The PE resin is also suitable as a material for the replenishing tank formed by blow molding. The material of the processing part, gears, sprockets and bearings is preferably such a resin as PA (polyamide) PBT (polybutylene terephthalate), UHMPE (ultrahigh molecular weight polyethylene), PPS (polyphenylene sulfide) and LCP (totally aromatic polyester resin, liquid crystal polymer).

Examples of the PA resin include such a polyamide resin as 66-nylon, 12-nylon and 6-nylon, and those containing glass fibers or carbon fibers are resistant to swelling with the processing solution and can be used in the invention.

A high molecular weight product like MC nylon and a compression molding product can be used without fiber reinforcement. The UHMPE resin is preferably used as a non-reinforced product, and suitable examples thereof include Lubmer, a trade name, produced by Mitsui Petrochemical Industries, Ltd., Hizex Million, a trade name, Saxin Corp. and Sunfine, a trade name, produced by Asahi Kasei Corp. The molecular weight thereof is preferably 1,000,000 or more, and more preferably from 1,000,000 to 5,000,000.

The PPS resin is preferably used by reinforcing with glass fibers or carbon fibers. Examples of the LCP resin include Victrex, a trade name, produced by ICI Japan Ltd., Econol, a trade name, produced by Sumitomo Chemical Co., Ltd., Xydar, a trade name, produced by Nippon Oil Co., Ltd. and Vectra, a trade name, produced by Polyplastics Co., Ltd.

In particular, the material for the conveying belt is preferably ultrahigh strength polyethylene fibers described in JP-A-4-151656 or a polyvinylidene fluoride resin.

A flexible material for a squeezing roller is preferably a foamed vinyl chloride resin, a foamed silicone resin or a foamed urethane resin. Examples of the foamed urethane resin include Rubycell, a trade name, produced by Toyo Polymer Co., Ltd.

The rubber material for a joint of the piping, a joint of the agitation jet pipe, and a sealing material is preferably EPDM rubber, silicone rubber or Viton rubber.

It is preferred that the reagent is directly added to the processing bath, and simultaneously, water is also added to the processing bath in an amount corresponding to the dilution ratio. Furthermore, it is also preferred that dissolution and dilution are automatically carried out in the replenisher tank by using an automatic preparation device to prepare a replenisher.

The processing agents used in the invention may be separately packaged respectively as a product for each of the process steps, and it is preferred that they are used as a kit containing the processing agents for the process steps as a suite. In the later case, it is more preferred that the processing agents for replenishment are also in the form of a cartridge that can be mounted onto and unmounted from the developing machine. The material of the containers for the processing agents may be any material including paper, plastics and metals, and the material, other than that of the container for the processing solution containing a bleaching agent, is preferably a plastic material having an oxygen permeation coefficient of $57\times10^{-6}$ mL/Pa·m$^2$·s (50 mL/m$^2$·atm·day). The oxygen permeation coefficient can be measured according to the method described in N. J. Calyan, "$O_2$ Permeation of Plastic Container", Modern Packing, December of 1968, p. 143 to 145.

Preferred examples of the plastic material include polyvinylidene chloride (PVDC), nylon (NY), polyethylene (PE), polypropylene (PP), polyester (PES), an ethylene-vinyl acetate copolymer (EVA), an ethylene-vinyl alcohol copolymer (EVAL), polyacrylonitrile (PAN), polyvinyl alcohol (PVA) and polyethylene terephthalate (PET).

Other than the container for the processing solution containing a bleaching agent, PVDC, NY, PE, EVA, EVAL and PET are preferably used for decreasing oxygen permeability.

These materials may be used solely after molding and may also be used by laminating plural materials thereof in a film form (i.e., a so-called composite film). The container may have various kinds of shapes, such as a bottle shape, a cubic shape and pillow shape, and the container in the invention is preferably a cubic type or the similar structures thereto, which are good in handling and can be reduced in volume after using.

The following structures are preferred as the composite film, but the invention is not construed as being limited thereto. That is, examples of the structure include PE/EVAL/PE, PE/aluminum foil/PE, NY/PE/NY, NY/PE/EVAL, PE/NY/PE/EVAL/PE, PE/NY/PE/PE/PE/NY/PE, PE/$SiO_2$ film/PE, PE/PVDC/PE, PE/NY/aluminum foil/PE, PE/PP/aluminum foil/PE, NY/PE/PVDC/NY, NY/EVAL/PE/EVAL/NY, NY/PE/EVAL/NY, NY/PE/PVDC/NY/EVAL/PE, PP/EVAL/PE, PP/EVAL/PP, NY/EVAL/PE, NY/aluminum foil/PE, paper/aluminum foil/PE, paper/PE/aluminum foil/PE, PE/PVDC/NY/PE, NY/PE/aluminum foil/PE, PET/EVAL/PE, PET/aluminum foil/PE and PET/aluminum foil/PET/PE.

The thickness of the composite film is generally about from 5 to 1,500 μm, and preferably about from 10 to 1,000 μm. The capacity of the finished container is generally about from 100 mL to 20 L, and preferably about from 500 mL to 10 L.

The container (cartridge) may have an outer casing formed with corrugated fiberboard or plastics and may also be formed integral molding with the outer casing.

The cartridge of the invention may be charged with various kinds of processing solutions. Examples thereof include a color developing solution, a monochrome developing solution, a bleaching solution, a conditioning solution, a reversal solution, a fixing solution, a blix solution and a stabilizing solution, and it is preferred that a cartridge having a low oxygen permeation coefficient is charged with a color developing solution, a monochrome developing solution, a fixing solution and a blix solution.

As a conventional container for a processing solution, a container having rigidity can be used that is produced by using a single layer material, such as high density polyethylene (HDPE), a polyvinyl chloride resin (PVC) or polyethylene terephthalate (PET) or a multilayer material, such as nylon/polyethylene (NY/PE).

A liquid container having flexibility can be used, whereby the volume of the container can be reduced after using, i.e., the space occupied by the container can be saved after using. Examples of the container having flexibility include such a liquid container that has a flexible container main body having a rigid opening part protruded from an upper part thereof with a lid material engaged thereto capable of shutting the opening, in which the container main body and the opening part are integrally molded, and the container main body has a bellows part on at least a part in the height direction thereof (as shown in FIGS. 1 and 2 of JP-A-7-5670).

A silver halide color photographic photosensitive material (hereinafter, sometimes simply referred to as a photosensitive material), to which the blix processing composition of the invention is applied, will be described below.

The silver halide color photographic photosensitive material used in the invention preferably contains a support having thereon at least one silver halide emulsion layer containing a yellow dye forming coupler, at least one silver halide emulsion layer containing a magenta dye forming coupler and at least one silver halide emulsion layer containing a cyan dye forming coupler, and having further thereon at least one non-coloring hydrophilic colloid layer having no photosensitivity, and examples of the hydrophilic colloid layer include a hydrophilic colloid layer described later, an antihalation layer, an intermediate layer and a colored layer.

The particle shape of the silver halide emulsion used in the invention is not particularly limited, and it is preferred that the emulsion contains cubic particles substantially having the {100} plane, tetradecahedral crystalline particles (which may have a higher dimensional surface through rounding apexes of the particles), octahedral crystalline particles, or tabular particles having an aspect ratio of 2 or more having the {100} plane or the {111} plane as the major plane. The aspect ratio is a value obtained by dividing the diameter of the circle corresponding to the projected area of the particle by the thickness of the particle. It is further preferred in the invention that the emulsion contains cubic particles or tetradecahedral particles.

The silver halide emulsion used in the invention contains silver chloride, and the content of silver chloride is preferably 90% by mole or more. From the standpoint of expedited processing, the content of silver chloride is more preferably 93% by mole or more, and further preferably 95% by mole or more.

The silver halide emulsion used in the invention preferably contains silver bromide and/or silver iodide. The content of silver bromide is preferably from 0.1 to 7% by mole, and more preferably from 0.5 to 5% by mole, owing to high contrast and excellent stability of a latent image. The content of silver iodide is preferably from 0.02 to 1% by mole, more preferably from 0.05 to 0.50% by mole, and most preferably from 0.07 to 0.40% by mole, owing to high sensitivity on exposure with high illuminance and high contrast.

The silver halide emulsion used in the invention is preferably a silver iodobromochloride emulsion, and is more preferably a silver iodobromochloride emulsion having the foregoing composition.

The silver halide emulsion used in the invention preferably has a silver bromide-containing phase and/or a silver iodide-containing phase. The silver bromide- or silver iodide-containing phase herein means a region where the concentration of silver bromide or silver iodide is higher than the surrounding. The halogen compositions of the silver bromide-containing phase or the silver iodide-containing phase and the surrounding may be continuously changed or may be steeply changed. The silver bromide- or silver iodide-containing phase may form a layer having a substantially constant concentration with some width in a certain region in the particle or may be a maximal point without extensity. The local silver bromide content in the silver bromide-containing phase is preferably 5% by mole or more, more preferably from 10 to 80% by mole, and most preferably from 15 to 50% by mole. The local silver iodide content in the silver iodide-containing phase is preferably 0.3% by mole or more, more preferably from 0.5 to 8% by mole, and most preferably from 1 to 5% by mole. The silver bromide- or silver iodide-containing phase may be present in plural regions in one particle, in which the silver bromide or silver iodide contents of the respective regions may be different from each other, and it is necessary that at least one region of the silver bromide- or silver iodide-containing phase is present, and preferably at least one of each of the phases is present, respectively.

The silver bromide-containing phase or the silver iodide-containing phase of the silver halide emulsion that is preferably used in the invention is preferably present in the form of a layer surrounding the particle. In one preferred embodiment, the silver bromide-containing phase or the silver iodide-containing phase in the form of a layer surrounding the particle has such a concentration distribution that is uniform within the phase in the circumferential direction of the particle. However, it is possible in the silver bromide-containing phase or the silver iodide-containing phase present in the form of a layer surrounding the particle that a maximal point or a minimal point of the silver bromide or the silver iodide content is present in the circumferential direction to cause a concentration distribution. For example, in the case where the silver bromide-containing phase or the silver iodide-containing phase is present in the form of a layer surrounding the particles in the vicinity of the surface of the particle, there are some cases where the silver bromide or silver iodide concentration at the corner or the edge of the particle is different from the concentration on the major surface. Furthermore, in addition to the silver bromide-containing phase or the silver iodide-containing phase present in the form of a layer surrounding the particle, such a silver bromide-containing phase or silver iodide-containing phase may be present on a specific region on the surface of the particle that is completely isolated but does not surround the particle.

In the case where the silver halide emulsion used in the invention contains the silver bromide-containing phase, it is preferred that the silver bromide-containing phase is formed in the form of a layer having a maximum in the silver bromide concentration inside the particle. In the case where the silver halide emulsion used in the invention contains the silver iodide-containing phase, it is preferred that the silver iodide-containing phase is formed in the form of a layer having a maximum in the silver iodide concentration on the surface of the particle. The silver bromide-containing phase or the silver iodide-containing phase in such a configuration is preferably constituted with a silver amount of from 3 to 30%, and more preferably from 3 to 15%, based on the volume of the particle from the standpoint of increasing the local concentration with a smaller silver bromide or silver iodide content.

The silver halide emulsion used in the invention preferably contains both the silver bromide-containing phase and the silver iodide-containing phase. In this case, the silver bromide-containing phase and the silver iodide-containing phase may be present in the same region or different regions in the particle, and it is preferred that they are present in different regions because the particle formation can be easily controlled. Furthermore, the silver bromide-containing phase may contain silver iodide, and the silver iodide-containing phase may contain silver bromide. In general, an iodide added during the formation of high silver chloride particles is liable to ooze on the surface of the particles in comparison to a bromide, and thus, the silver iodide-containing phase is liable to be formed in the vicinity of the surface of the particles. Therefore, in the case where the silver bromide-containing phase and the silver iodide-containing phase are present in the different regions in the particle, it is preferred that the silver bromide-containing phase is present inside the silver iodide-containing phase. In this case, another silver bromide-containing phase may be present further outside the silver iodide-containing phase present in the vicinity of the surface of the particle.

The silver bromide content or the silver iodide content of the silver halide emulsion used in the invention is increased by forming the silver bromide-containing phase or the silver iodide-containing phase in the particles, and there is such a possibility that the silver chloride content is decreased to an extent than necessary to impair the expedited processing property. Therefore, it is preferred that the silver bromide-containing phase and the silver iodide-containing phase are adjacent to each other to congregate the functions for controlling the photographic action in the vicinity of the surface of the particle. According to the consideration, it is preferred that the silver bromide-containing phase is formed at a position of from 50 to 100% of the particle volume measured from the center of the particle, and the silver iodide-containing phase is formed at a position of from 85 to 100% of the particle volume measured from the center of the particle. It is further preferred that the silver bromide-containing phase is formed at a position of from 70 to 95% of the particle volume, and the silver iodide-containing phase is formed at a position of from 90 to 100% of the particle volume.

The introduction of a bromide or iodide ion for adding silver bromide or silver iodide to the silver halide emulsion that is preferably used in the invention may be carried out in such a manner that a solution of a bromide salt or an iodide salt is solely added, or in alternative, a bromide salt or iodide salt solution is added along with the addition of a silver salt solution or a chloride salt solution. In the latter case, the bromide salt or iodide salt solution and the chloride salt solution may be separately added, or in alternative, they may be added in the form of a mixed solution of a bromide salt or an iodide salt and a chloride salt. The bromide salt or the iodide salt is added in the form of a soluble salt, such as a bromide salt or an iodide salt of an alkali metal or an alkaline earth metal. It is also possible that a bromide or iodide ion is introduced by cleaving a bromide ion or an iodide ion from an organic molecule as described in U.S. Pat. No. 5,389,508. Minute silver bromide particles or minute silver iodide particles may also be used as another bromide or iodide source.

The addition of a bromide salt or an iodide salt may be carried out as concentrated at one stage during the formation of the particles or may be carried out over a certain period. The position in a high silver chloride emulsion, to which an iodide ion is introduced, is restricted from the standpoint of obtaining an emulsion having high sensitivity and low fog. The increase in sensitivity is smaller when an iodide ion is introduced to a position more inwardly in the emulsion particle. Therefore, the addition of an iodide salt solution is preferably carried out at a position of 50% or outside of the particle volume, more preferably 70% or outside, and most preferably 85% or outside. The addition of an iodide salt solution is preferably completed at a position of 98% or inside, and most preferably 96% or inside. In the case where the addition of the iodide salt solution is completed at a position slightly inside the surface of the particle, an emulsion having high sensitivity and low fog can be obtained.

The addition of the bromide salt solution is preferably carried out at a position of 50% or outside of the particle volume, and more preferably 70% or outside.

The sphere equivalent diameter of particles referred herein means a diameter of a sphere that has the same volume of the respective particles. The silver halide emulsion used in the invention is preferably constituted with particles having a monodisperse particle size distribution.

The variation coefficient of the sphere equivalent diameter of all the particles contained in the silver halide emulsion used in the invention is preferably 20% or less, more preferably 15% or less, and further preferably 10% or less. The variation coefficient of the sphere equivalent diameter is a percentage of the standard deviation of the sphere equivalent diameter of the respective particles with respect to the average of the sphere equivalent diameter. It is preferred at this time that monodisperse emulsions are used as a mixture in the same layer or are coated as a multilayer, so as to obtain a wide latitude.

The sphere equivalent diameter of the particles contained in the silver halide emulsion used in the invention is preferably 0.6 $\mu$m or less, more preferably 0.5 $\mu$m or less, and further preferably 0.4 $\mu$m or less. The lower limit of the sphere equivalent diameter of the silver halide particles is preferably 0.05 $\mu$m, and more preferably 0.1 $\mu$m. A particle having a sphere equivalent diameter of 0.6 $\mu$m corresponds to a cubic particle having an edge length of about 0.48 $\mu$m, a particle having a sphere equivalent diameter of 0.5 $\mu$m corresponds to a cubic particle having an edge length of about 0.4 $\mu$m, and a particle having a sphere equivalent diameter of 0.4 $\mu$m corresponds to a cubic particle having an edge length of about 0.32 $\mu$m.

The silver halide emulsion used in the invention preferably contains iridium. It is preferred that iridium forms an iridium complex, and a 6-coordinate complex having six ligands with iridium as a central metal is preferred for incorporating uniformly in the silver halide crystals. As one preferred embodiment of iridium used in the invention, a 6-coordinate complex having Cl, Br or I as ligands with Ir as a central metal is preferred, and a 6-coordinate complex with Ir as a central metal where all the six ligands are of Cl, Br or I. In this case, Cl, Br and I may be present as mixture in the six ligands. The 6-coordinate complex having Cl, Br or I as ligands with Ir as a central metal is particularly preferably contained in the silver bromide-containing phase for obtaining hard gradation with high illuminance exposure.

Examples of the 6-coordinate complex with Ir as a central metal where all the six ligands are of Cl, Br or I include $(IrCl_6)^{2-}$, $(IrCl_6)^{3-}$, $(IrBr_6)^{2-}$, $(IrBr_6)^{3-}$ and $(IrI_6)^{3-}$, but it is not limited thereto.

As other preferred embodiments of iridium used in the invention, a 6-coordinate complex having at least one ligand other than halogen and cyan with Ir as a central metal is preferred, a 6-coordinate complex having $H_2O$, OH, O, OCN, thiazole or substituted thiazole, or thiadiazole or substituted thiadiazole as ligands with Ir as a central metal is preferred, and a 6-coordinate complex having $H_2O$, OH, O, OCN, thiazole or substituted thiazole, or thiadiazole or substituted thiadiazole as at least one ligand and Cl, Br or I as the remaining ligands with Ir as a central metal is further preferred. Moreover, a 6-coordinate complex having 5-methylthiazole, 2-chloro-5-fluorothiazole or 2-bromo-5-fluorothiazole as one or two ligands and Cl, Br or I as the remaining ligands with Ir as a central metal is most preferred.

Examples of the 6-coordinate complex having $H_2O$, OH, O, OCN, thiazole or substituted thiazole, or thiadiazole or substituted thiadiazole as at least one ligand and Cl, Br or I as the remaining ligands with Ir as a central metal include $(Ir(H_2O)Cl_5)^{2-}$, $(Ir(OH)Br_5)^{3-}$, $(Ir(OCN)Cl_5)^{3-}$, $(Ir(thiazole)Cl_5)^{2-}$, $(Ir(5\text{-methylthiazole})Cl_5)^{2-}$, $(Ir(2\text{-chloro-5-fluorothiadiazole})Cl_5)^{2-}$ and $(Ir(2\text{-bromo-5-fluorothiadiazole})Cl_5)^{2-}$, but it is not limited thereto.

The silver halide emulsion used in the invention preferably contains, in addition to the iridium complex, a 6-coordinate complex having a CN ligand with Fe, Ru, Re or Os as a central metal, such as $(Fe(CN)_6)^{4-}$, $(Fe(CN)_6)^{3-}$, $(Ru(CN)_6)^{4-}$, $(Re(CN)_6)^{4-}$ and $(Os(CN)_6)^{4-}$. The silver halide emulsion used in the invention preferably further contains a pentachloronitrosyl complex or a pentachlorothionitrosyl complex with Ru, Re or Os as a central metal or a 6-coordinate complex having Cl, Br or I as ligands with Rh as a central metal. These ligands may be partly aquated.

The metallic complex having been described are anions, and in the case where a salt is formed with a cation, the cation is preferably those that are soluble in water. Preferred examples thereof include an alkali metal ion, such as a sodium ion, a potassium ion, a rubidium ion, a cesium ion and a lithium ion, an ammonium ion and an alkylammonium ion. The metallic complex may be used by dissolving in water or a mixed solvent with a suitable organic solvent that is miscible with water (such as an alcohol, an ether, a glycol, a ketone, an ester and an amide). The metallic complex is preferably added during the formation of particles in an amount of from $1\times10^{-10}$ to $1\times10^{-3}$ mole, and most preferably from $1\times10^{-9}$ to $1\times10^{-5}$ mole, per mole of silver, while the optimum amount varied depending on the species thereof.

The metallic complex is preferably incorporated in the silver halide emulsion in such a manner that it is directly added to the reaction solution upon formation of the silver halide particles, or in alternative, it is added to a halide ion aqueous solution or other solutions for forming silver halide particles, which is then added to the reaction solution for forming the particles. It is also preferred that the metallic complex is incorporated by physical aging with fine particles having the metallic complex incorporated therein. The metallic complex may be incorporated into the silver halide particles by a combination of these methods.

In the case where the complex is incorporated in the silver halide particles, while it may be uniformly present inside the particle, it is preferably present only in the surface layer of the particle as described in JP-A-4-208936, JP-A-2-125245 and JP-A-3-188437, and it is also preferred that the complex is present only in the interior of the particle, and a layer containing no complex is added to the surface of the particle. It is also preferred that the surface phase of the particle is modified by physical aging with fine particles having the complex incorporated therein as described in U.S. Pat. No. 5,252,451 and U.S. Pat. No. 5,256,530. Furthermore, these methods may be used in combination, and plural kinds of complexes may be incorporated into one silver halide particle. The halogen composition of the position containing the complex is not particularly limited, and the 6-coordinate complex with Ir as a central metal where all the six ligands are of Cl, Br or I is preferably contained at a part having a maximal concentration of silver bromide.

The silver halide emulsion used in the invention is generally chemically sensitized. Examples of the method of chemical sensitization include sulfur sensitization represented by addition of an unstable sulfur compound, noble metal sensitization represented by gold sensitization, and reduction sensitization, which may be used solely or in combination. Preferred examples of the compound used in the chemical sensitization include those described in JP-A-62-215272, page 18, right lower column to page 22, right upper column. In particular, those having been subjected to gold sensitization are preferred because fluctuation in photographic performance upon scanning exposure with laser light can be decreased by carrying out gold sensitization.

In order to carry out gold sensitization, various kinds of inorganic gold compounds, a gold(I) complex having an inorganic ligand, and a gold(I) complex having an organic ligand may be utilized. Examples of the inorganic gold compound include chloroauric acid and a salt thereof, and examples of the gold(I) complex having an inorganic ligand include a dithiocyanate gold compound, such as potassium dithiocyanate gold(I), and a dithiosulfate gold compound, such as trisodium dithiosulfate gold(I).

Examples of the gold(I) compound having an organic ligand (organic compound) include a bisgold(I)mesoionic heterocyclic compound, such as bis(1,4,5-trimethyl-1,2,4-triazolium-3-thiolate) aurate(I) tetrafluoroborate, described in JP-A-4-267249, an organic mercaptogold(I) complex, such as potassium bis(1-(3-(2-sulfonatobenzamide)phenyl)-5-mercaptotetrazole potassium salt) aurate(I) pentahydrate, described in JP-A-11-218870, and a gold(I) compound coordinated with a nitrogen-containing compound anion, such as sodium (1-methylhydantoinate) aurate(I) tetrahydrate, described in JP-A-4-268550. The gold(I) compound having an organic ligand may be used in such a manner that the compound is previously synthesized and isolated, or in alternative, the compound is formed by mixing an organic ligand and an Au compound (such as chloroauric acid and a salt thereof) and added to the emulsion without isolation. Furthermore, it is also possible that an organic ligand and an Au compound (such as chloroauric acid and a salt thereof) are separately added to the emulsion to form the gold(I) compound having an organic ligand in the emulsion.

Furthermore, a gold(I) thiolate compound described in U.S. Pat. No. 3,503,749, gold compounds described in JP-A-8-69074, JP-A-8-69075 and JP-A-9-269554, and compounds described in U.S. Pat. No. 5,620,841, No. 5,912,112, No. 5,620,841, No. 5,939,245 and No. 5,912,111 may also be used. The addition amount of the compounds widely may vary depending on cases and is generally from $5\times10^{-7}$ to $5\times10^{-3}$ mole, and preferably from $5\times10^{-6}$ to $5\times10^{-4}$ mole, per mole of silver halide.

Colloidal gold sulfide may also be used, and the production process thereof is described in *Research Disclosure*, No. 37154, *Solid State Ionics*, vol. 79, p. 60 to 66 (1995), and *Compt. Rend. Hebt. Seances, Acad. Sci. Sect. B*, vol. 263, p. 1328 (1966). The addition amount of gold sulfide colloid may vary within a wide range and is generally from $5\times10^{-7}$ to $5\times10^{-3}$ mole, and preferably from $5\times10^{-6}$ to $5\times10^{-4}$ mole, in terms of gold atom per mole of silver halide.

Chalcogen sensitization can be carried out with the same molecule as the gold sensitization, and a molecule that can release $AuCh^-$ may be used. Herein, Au represents Au(I), and Ch represents a sulfur atom, a selenium atom or a tellurium atom. Examples of the molecule that can release $AuCh^-$ include a gold compound, such as AuCh-L, wherein L represents an atomic group capable of constituting a molecule by bonding to AuCh. One or more ligand may be coordinated on Au in addition to Ch-L. Specific examples of the compound include an Au(I) salt of a thiosaccharide (such as gold thioglucose, e.g., α-gold thioglucose, gold peracetyl thioglucose, gold thiomannose, gold thiogalactose and gold thioarabinose), an Au(I) salt of a selenosaccharide (such as gold peracetyl selenoglucose and gold peracetyl selenomannose), and an Au(I) salt of tellurosaccharide. The thiosaccharide, the selenosaccharide and the tellurosaccharide herein mean such compounds formed by substituting a hydroxyl group at the anomer position with an SH group, an SeH group and a TeH group. The addition amount of the compounds may vary within a wide range and is generally from $5\times10^{-7}$ to $5\times10^{-3}$ mole, and preferably from $3\times10^{-6}$ to $3\times10^{-4}$ mole, per mole of silver halide.

The silver halide emulsion used in the invention may be subjected to the gold sensitization in combination with other sensitization methods, such as sulfur sensitization, selenium sensitization, tellurium sensitization, reduction sensitization and noble metal sensitization other than gold sensitization. In particular, sulfur sensitization or selenium sensitization is preferably used in combination.

Various kinds of compounds or precursors thereof may be added to the silver halide emulsion used in the invention in order to prevent fogging during the production process, storage or the photographic process of the photosensitive material or to stabilize the photographic performance. Preferred examples of the compounds include those described in JP-A-62-215272, pages 39 to 72. A 5-arylamino-1,2,3,4-thiatriazole compound (in which the aryl residual group has at least one electron attracting group) described in EP 0,447,647 is also preferably used.

In the invention, in order to improve storage stability of the silver halide emulsion, the following compounds are preferably used, i.e., a hydroxamic acid derivative described in JP-A-11-109576, a cyclic ketone compound having a double bond substituted at both ends thereof an amino group or a hydroxyl group adjacent to a carbonyl group described in JP-A-11-327094 (in particular, those described in paragraphs 0036 to 0071 represented by the general formula (S1) are incorporated herein by reference), a sulfo-substituted catechol or hydroquinone compound (such as 4,5-dihydroxy-1,3-benzenedisulfonic acid, 2,5-dihydroxy-1,4-benzenedisulfonic acid, 3,4-dihydroxybenzenesulfonic acid, 2,3-dihydroxybenzenesulfonic acid, 2,5-dihydroxybenzenesulfonic acid, 3,4,5-trihydroxybenzenesulfonic acid and salts thereof) described in JP-A-11-143011, a hydroxylamine compound represented by the general formula (A) described in U.S. Pat. No. 5,556,741 (the description in U.S. Pat. No. 5,556,741, column 4, line 56 to column 11, line 22 is preferably applied in the invention and is incorporated herein by reference), and a water soluble reducing agent represented by the general formulae (I) to (III) described in JP-A-11-102045.

The silver halide emulsion used in the invention may contain a spectral sensitizing dye in order to so-called spectral sensitivity, i.e., exhibition of sensitivity to light of a desire wavelength region. Examples of the spectral sensitizing dye used for spectral sensitization to blue, green and red regions include those described in *Heterocyclic compounds—Cyanine dyes and related compounds*, by M. Harmer (published by John Wiley & Sons (New York and London) in 1964). Preferred examples of the compound and the spectral sensitizing method include those described in JP-A-62-215272, pages 22 to 38. In particular, as a red-sensitive spectral sensitizing dye for silver halide emulsion particles having a high silver chloride content, a spectral sensitizing dye described in JP-A-3-123340 is significantly preferred from the standpoint of stability, strength of adsorption and dependency of exposure on temperature.

The addition amount of the spectral sensitizing dye varies within a wide range and is preferably from $0.5\times10^{-6}$ to $1.0\times10^{-2}$ mole, and more preferably from $1.0\times10^{-6}$ to $5.0\times10^{-3}$ mole, per mole of silver halide.

In the photosensitive material, to which the invention applied, a dye that can be decolorized by treatment described in EP 0,337,490A2, pages 27 to 76 (in particular, an oxonol dye and a cyanine dye) is preferably added to a hydrophilic colloid layer in order to prevent irradiation and halation and to improve safety to safelight. Furthermore, a dye described in EP 0,819,977 is preferably added. There are some compounds among these water soluble dyes that deteriorate color separation or safety to safelight if the using amount thereof is increased. As a dye that can be used without deterioration in color separation, water soluble dyes described in JP-A-5-127324, JP-A-5-127325 and JP-A-5-216185 are preferred.

The silver halide color photographic photosensitive material of the invention is preferably a reflective silver halide photographic photosensitive material, and particularly preferably color photographic printing paper.

Examples of a support used in the invention include a reflective support and a transparent support. In particular, with respect to the reflective support and the silver halide emulsion, and a heterogeneous metallic ion species doped in the silver halide particles, a storage stabilizer or a antifogging agent of the silver halide emulsion, a chemical sensitizing method (sensitizer), a spectral sensitizing method (spectral sensitizer), cyan, magenta and yellow couplers and a emulsion dispersing method therefor, a color image stability improving agent (such as stain preventing agent and a discoloration preventing agent), a dye (colored layer), a layer structure of the photosensitive material, and a film pH of the photosensitive material, those described in the positions of the publications shown in Table 1 below can be preferably applied.

TABLE 1

| Element | JP-A-7-104448 | JP-A-7-77775 | JP-A-7-301895 |
|---|---|---|---|
| Reflective support | col. 7, 1.12 to col. 12, 1.19 | col. 35, 1.43 to col. 44, 1.1 | col. 5, 1.40 to col. 9, 1.26 |
| Silver halide emulsion | col. 72, 1.29 to col. 74, 1.18 | col. 44, 1.36 to col. 46, 1.29 | col. 77, 1.48 to col. 80, 1.28 |
| Heterogeneous metallic ion species | col. 74, 1.19 to 1.44 | col. 46, 1.30 to col. 47, 1.5 | col. 80, 1.29 to col. 81, 1.6 |
| Storage stabilizer or | col. 75, 1.9 to | col. 47, 1.20 to | col. 18, 1.11 to |

TABLE 1-continued

| Element | JP-A-7-104448 | JP-A-7-77775 | JP-A-7-301895 |
|---|---|---|---|
| antifogging agent | 1.18 | 1.29 | col. 31, 1.37 (in particular, mercapto-heteracyclic compound) |
| Chemical sensitizing method (chemical sensitizer) | col. 74, 1.45 to col. 75, 1.6 | col. 47, 1.7 to 1.17 | col. 81, 1.9 to 1.17 |
| Spectral sensitizing method (spectral sensitizer) | col. 75, 1.19 to col. 76, 1.45 | col. 47, 1.30 to col. 49, 1.6 | col. 81, 1.21 to col. 82, 1.48 |
| Cyan coupler | col. 12, 1.20 to col. 39, 1.49 | col. 62, 1.50 to col. 36, 1.16 | col. 88, 1.49 to col. 89, 1.16 |
| Yellow coupler | col. 87, 1.40 to col. 88, 1.3 | col. 63, 1.17 to 1.30 | col. 89, 1.17 to 1.30 |
| Magenta coupler | col. 88, 1.4 to 1.18 | col. 63, 1.3 to col. 64, 1.11 | col. 31, 1.34 to col. 77, 1.44 and col. 88, 1.32 to 1.46 |
| Emulsion dispersing method for coupler | col. 71, 1.3 to col. 72, 1.11 | col. 61, 1.36 to 1.49 | col. 87, 1.35 to 1.48 |
| Color image storage stability improving agent (stain preventing agent) | col. 39, 1.50 to col. 70, 1.9 | col. 61, 1.50 to col. 62, 1.40 | col. 87, 1.49 to col. 88, 1.48 |
| Discoloration preventing agent | col. 70, 1.10 to col. 71, 1.2 | | |
| Dye (coloring agent) | col. 77, 1.42 to col. 78, 1.41 | col. 7, 1.14 to col. 19, 1.42 and col. 50, 1.3 to col. 51, 1.14 | col. 9, 1.27 to col. 18, 1.10 |
| Gelatin species | col. 78, 1.42 to 1.48 | col. 51, 1.15 to 1.20 | col. 83, 1.13 to 1.19 |
| Layer structure of photosensitive material | col. 39, 1.11 to 1.26 | col. 44, 1.2 to 1.35 | col. 31, 1.38 to col. 32, 1.33 |
| Film pH of photo-sensitive material | col. 72, 1.12 to 1.28 | | |
| Scanning exposure | col. 76, 1.6 to col. 77, 1.41 | col. 49, 1.7 to col. 50, 1.2 | col. 82, 1.49 to col. 83, 1.12 |
| Preservative in developing solution | col. 88, 1.19 to col. 89, 1.22 | | |

Other useful examples of a cyan coupler, a magenta coupler and a yellow coupler used in the invention include couplers described in JP-A-62-215272, page 91, right upper column, line 4 to page 121, left upper column, line 6, JP-A-2-33144, page 3, right upper column, line 14 to page 18, left upper column, last line, and page 30, right upper column, line 6 to page 35, right upper column, line 11, and EP 0,355,660A2, page 4, lines 15 to 27, page 5, line 30 to page 28, last line, page 45, lines 29 to 31, and page 47, line 23 to page 63, line 50.

Compounds represented by the general formulae (II) and (III) described in WO98/33760 and the general formula (D) described in JP-A-10-221825 may be preferably added in the invention.

Preferred examples of a cyan dye forming coupler (sometimes simply referred to as a cyan coupler herein) that can be used in the invention include a pyrrolotriazole series coupler, and a coupler represented by the general formula (I) or (II) described in JP-A-5-313324, a coupler represented by the general formula (I) described in JP-A-6-347960 and example couplers described in these publications are particularly preferred. Phenol series and naphthol series couplers are also preferred, and for example, a cyan coupler represented by the general formula (ADF) described in JP-10-333297 is preferred. Other examples of a cyan coupler include pyrroloazole type cyan couplers described in EP 0,488,248 and EP 0,491,197A1, a 2,5-diacylaminophenol coupler described in U.S. Pat. No. 5,888,716, and a pyrazoloazole type cyan couplers having an electron attracting group or a hydrogen bond group at the 6-position described in U.S. Pat. No. 4,873,183 and No. 4,916,051, and in particular, pyrazoloazole type cyan couplers having a carbamoyl group at the 6-position described in JP-A-8-171185, JP-A-8-311360 and JP-A-8-339060 are also preferred.

The following couplers can also be used in the invention, i.e., a diphenylimidazole series cyan coupler described in JP-A-2-33144, as well as a 3-hydroxypyridine series cyan coupler described in EP 0,333,185A2 (in particular, a 2-equivalent coupler obtained by adding a chlorine releasing group to the 4-equivalent coupler of the example coupler (42), and the example couplers (6) and (9) are preferred), a cyclic active methylene series cyan coupler described in JP-A-64-32260 (in particular, the example couplers 3, 8 and 34 are preferred), a pyrrolopyrazole type cyan coupler described in EP 0,456,226A1, and a pyrroloimidazole type cyan coupler described in EP 0,484,909.

Among these cyan couplers, a pyrroloazole series cyan coupler represented by the general formula (I) described in JP-11-282138 is particularly preferred, and it can be applied as it is including the example cyan couplers (1) to (47) described in paragraphs 0012 to 0059 of the publication, which are incorporated herein by reference.

Examples of a magenta dye forming coupler (sometimes simply referred to as a magenta coupler herein) that can be used in the invention include the 5-pyrazolone series magenta coupler and the pyrazoloazole series magenta coupler described in the known publications shown in Table 1, and the following couplers are preferably used from the standpoint of hue and stability and coloring property of an image, i.e., a pyrazolotriazole coupler having a secondary or tertiary alkyl group connected to the 2-, 3- or 6-position of the pyrazolotriazole ring described in JP-A-61-65245, a pyrazoloazole coupler containing a sulfonamide group in the molecule described in JP-A-61-65246, a pyrazoloazole coupler having an alkoxyphenylsulfonamide ballast group described in JP-A-61-147254, and pyrazoloazole couplers having an alkoxy group or an aryloxy group at the 6-position described in EP 0,226,849A and EP 0,294,785A. In particular, a pyrazoloazole coupler represented by the general formula (M-1) described in JP-A-8-122984 is preferred as the magenta coupler, and paragraphs 0009 to 0026 of the publication can be applied to the invention as they are, and are incorporated herein by reference. In addition, pyrazoloazole couplers having steric hindrance groups at both the 3- and 6-positions described in EP 0,854,384 and EP 0,884,640 are preferably used.

As a yellow dye forming coupler (sometimes simply referred to as a yellow coupler herein), the following compounds may be used depending on necessity. That is, an acylacetamide type yellow coupler having a 3- to 5-membered cyclic structure in an acyl group described in EP 0,447,969A1, a malondianilide type yellow coupler having a cyclic structure described in EP 0,482,552A1, pyrrole-2 or 3-yl or indole-2 or 3-yl carbonylacetic acid anilide series couplers described in EP 0,953,870A1, EP 0,953,871A1, EP 0,953,872A1, EP 0,953,873A1, EP 0,953,874A1 and EP 0,953,875A1, and an acylacetamide type yellow coupler having a dioxane structure described in U.S. Pat. No. 5,118,599 are preferably used. Among these, an acylacetamide type yellow coupler where the acyl group is a 1-alkylcyclopropane-1-carbonyl group, and a malondianilide type yellow coupler where one of anilide moieties constitutes an indoline ring are preferably used. The couplers may be used solely or in combination.

It is preferred that the coupler used in the invention is impregnated with a loadable latex polymer (described, for example, in U.S. Pat. No. 4,203,716) in the presence (or absence) of a high boiling point solvent shown in Table 1, and dissolved with a water insoluble and organic solvent soluble polymer, followed by subjecting to emulsion dispersion in a hydrophilic colloid aqueous solution. Preferred examples of the water insoluble and organic solvent soluble polymer include homopolymers and copolymers described in U.S. Pat. No. 4,857,449, column 7 to 15 and WO88/00723, pages 12 to 30. More preferred examples thereof include a methacrylate series polymer and an acrylamide series polymer, and in particular, an acrylamide series polymer is preferably used from the standpoint of stability of a color image.

A known a color mixing preventing agent may be used in the invention, and those described in the following publications are preferred.

That is, preferred examples thereof include a high molecular weight redox compound described in JP-A-5-333501, phenidone and hydrazine series compounds described in WO98/33760 and U.S. Pat. No. 4,923,787, and white couplers described in JP-A-5-249637, JP-A-10-282615 and DE 19629142A1. In the case where the pH of the developing solution is raised to expedite development, in particular, it is preferred to use redox compounds described in DE 19618786A1, EP 0,839,623A1, EP 0,842,975A1, DE 19806846A1 and FR 2,760,460A1.

It is preferred in the invention to use a compound having a triazine skeleton having a high molar extinction coefficient as an ultraviolet ray absorbing agent, and for example, the following compounds may be used. The compounds are preferably added to a photosensitive layer and/or a non-photosensitive layer. That is, example thereof include compounds described in JP-A-46-3335, JP-A-55-152776, JP-A-5-197074, JP-A-5-232630, JP-A-5-307232, JP-A-6-211813, JP-A-8-53427, JP-A-8-234368, JP-A-8-239368, JP-A-9-31067, JP-A-10-115898, JP-A-10-147577, JP-A-10-182621, DE 19739797A, EP 0,711,804A and JP-A-8-501291.

As a binder or a protective colloid that can be used in the photosensitive material according to the invention, gelatin is advantageously used, and other hydrophilic colloids may be used solely or in combination with gelatin. Gelatin preferably has a content of a heavy metal contained as impurities of iron, copper, zinc, manganese or the like of 5 ppm or less, and more preferably 3 ppm or less. The amount of calcium contained in the photosensitive material is preferably 20 $mg/m^2$ or less, more preferably 10 $mg/m^2$ or less, and most preferably 5 $mg/m^2$ or less.

In order to prevent fungus and bacteria growing in the hydrophilic colloid layer to deteriorate images, an antibacterial and antifungal agent as described in JP-A-63-271247 is preferably added. The pH value of the film of the photosensitive material is preferably from 4.0 to 7.0, and more preferably from 4.0 to 6.5.

A surface active agent may be added to the photosensitive material of the invention, whereby the photosensitive material is improved in coating stability, prevented from static charge, and adjusted in charging amount. Examples of the surface active agent include an anionic surface active agent, a cationic surface active agent, a betaine surface active agent and a nonionic surface active agent, and specific examples thereof include those described in JP-A-5-333492. The surface active agent used in the invention is preferably a surface active agent containing a fluorine atom. In particular, a fluorine atom-containing surface active agent is preferably used. The fluorine atom-containing surface active agent may be used solely or in combination with another known surface active agent, and it is preferably used in combination with another known surface active agent. The addition amount of the surface active agent is not particularly limited, and it is generally from $1\times10^{-5}$ to 1 $g/m^2$, preferably from $1\times10^{-4}$ to $1\times10^{-1}$ $g/m^2$, and more preferably from $1\times10^{-3}$ to $1\times10^{-2}$ $g/m^2$.

The photosensitive material can form an image through an exposing step of irradiating with light corresponding to image information, and a developing step of developing the photosensitive material thus irradiated with light.

The photosensitive material is used in an ordinary printing system using a negative printer, and is also suitable for a scanning exposure system using a cathode ray tube (CRT). A cathode ray tube exposure device is simple, compact and low-cost, in comparison to a device using a laser. It is also convenient in adjustment in axis and color of light. As the cathode ray tube used for imagewise exposure, various kinds of illuminants emitting light in spectral regions depending on necessity. For example, one of a red illuminant, a green illuminant and a blue illuminant or a mixture of two or more of them is used. The spectral region is not limited to red, green and blue, but a fluorescent body emitting light in yellow, orange or violet or in an infrared region may be used. In particular, a cathode ray tube emitting white light by mixing these illuminants is often used.

In the case where the photosensitive material has plural photosensitive layers having different spectral sensitivity distributions, and the cathode ray tube has a fluorescent body emitting light in plural spectral regions, exposure may be carried out with plural colors at a time, i.e., image signals of plural colors may be input to the cathode ray tube to emit light from the surface of the tube. Such a method may also be employed in that image signals of respective colors are sequentially input to effect light emission of respective colors, and the exposure is carried out through a film cutting other colors than the color to be exposed (planar sequential exposure), and in general, the planer sequential exposure is preferred since a cathode ray tube of high resolution can be used in the planar sequential exposure.

The photosensitive material of the invention is preferably applied to a digital scanning exposure system using monochromatic high density light, such as a gas laser, a light emitting diode, a semiconductor laser, and a secondary harmonic generation (SGH) light source combining a semiconductor laser or a solid laser using a semiconductor laser as an exciting light source with a nonlinear optical crystal. In order to make the system compact and inexpensive, a semiconductor layer or a secondary harmonic generation (SGH) light source combining a semiconductor laser or a solid laser with a nonlinear optical crystal is preferably used. In order to design such a system that is compact and inexpensive and has a long service life and high stability, a semiconductor laser is preferably used, and it is preferred that at least one of exposure light sources is a semiconductor laser.

In the case where the scanning exposure light source is used, the spectral sensitivity maximal wavelength of the photosensitive material of the invention may be arbitrarily set depending on the wavelength of the scanning exposure light source used. A solid laser using a semiconductor laser as an exciting light source and an SHG light source obtained by combining a semiconductor laser the a nonlinear optical crystal provide blue light or green light since the oscillation wavelength of the laser can be divided in half. Therefore, it is possible that spectral sensitivity maxima of the photosensitive material may be provided in the ordinary three wavelength regions of blue, green and red. The exposure time in the scanning exposure, as it is defined as a time for exposing a pixel size with a pixel density of 400 dpi, is preferably $10^{-4}$ second or less, and more preferably $10^{-6}$ second or less.

The silver halide color photographic photosensitive material of the invention can be used by combining with exposure and development systems described in the following publications. That is, examples of the development system include an automatic printing and developing system described in JP-A-10-333253, a photosensitive material conveying device described in JP-A-2000-10206, a recording system including an image reading device described in JP-A-11-215312, an exposure system of a color image recording system described in JP-A-11-88619 and JP-A-10-202950, a digital photographic printing system containing a remote diagnosis system, and a photographic printing system having an image recording device.

Such a scanning exposure system that is preferably applied to the invention is described in detail in the publications shown in Table 1.

In the case where the photosensitive material of the invention is exposed in a printer, a band stop filter described in U.S. Pat. No. 4,880,726 is preferably used, whereby light color mixing is removed, and the color reproducibility is significantly improved.

It is possible in the invention that duplication control is applied by previously exposing in a yellow microdot pattern before applying image information, as described in EP 0,789,270A1 and EP 0,789,480A1.

EXAMPLE

Example 1

Preparation of Bleaching Agent Part of Blix Processing Composition, No. 1

A bleaching agent part of a blix processing composition having the following formulation was prepared.

| (Blix processing composition) | Bleaching agent part |
|---|---|
| Water | 350 mL |
| Ammonium(III) ethylenediamine tetraacetate | shown in Table 2 |
| Ethylenediamine tetraacetic acid | shown in Table 2 |
| m-Carboxysulfinic acid | 20.0 g |
| Succinic acid | 47.2 g |
| Water to make | 1,000 mL |
| pH (at 25° C., adjusted with ammonia or nitric acid) | shown in Table 2 |
| Specific gravity (at 25° C., adjusted with ammonium nitrate) | shown in Table 2 |

Evaluation of Deposition Property 1,300 mL of the bleaching agent part was placed in a container made of high density polyethylene (HDPE) described in FIG. 1 of JP-A-11-282148 and was allowed to stand under a temperature condition at −5° C. or 50° C. for 4 weeks. After lapsing the time, presence of precipitation and deposition was visually observed, and the formation ratio of a ferrous salt compound was measured. The HDPE container had an oxygen permeation rate of 10 mL/24 hrs.

In the visual observation, a sample causing no abnormality was designated as grade A, a sample causing no deposition but suffering slight turbidity was designated as grade B, a sample causing a small amount of deposition, which was however dissolved upon standing at room temperature for one day, was designated as grade C, a sample causing a certain amount of deposition, which was however dissolved upon standing at room temperature for three days, was designated as grade D, and a sample causing a large amount of precipitation and deposition, which were not dissolved even upon standing at room temperature for 7 days, was designated as grade E.

TABLE 2

| No. | EDTAFe (III) concentration (mole/L) | EDTA concentration (mole/L) | pH | Specific gravity | Time-lapse deposition at −5° C. | Time-lapse deposition at 50° C. | Time-lapse $Fe^{2+}$ at 50° C. | Note |
|---|---|---|---|---|---|---|---|---|
| 1 | 0.7 | 0 | 2.5 | 1.160 | A | E | 3 | Comparison |
| 2 | 0.7 | 0.1 | 2.5 | 1.160 | A | A | 3 | Invention |
| 3 | 0.7 | 0.3 | 2.5 | 1.160 | A | A | 3 | Invention |
| 4 | 0.7 | 3.0 | 2.5 | 1.160 | B | A | 3 | Invention |
| 5 | 0.7 | 10.0 | 2.5 | 1.160 | E | B | 3 | Comparison |
| 6 | 0.7 | 0.3 | 1.0 | 1.160 | E | D | 3 | Comparison |
| 7 | 0.7 | 0.3 | 2.0 | 1.160 | A | A | 3 | Invention |
| 8 | 0.7 | 0.3 | 3.5 | 1.160 | A | A | 5 | Invention |
| 9 | 0.7 | 0.3 | 4.5 | 1.160 | D | B | 20 | Comparison |
| 10 | 0.7 | 0.3 | 5.5 | 1.160 | D | B | 36 | Comparison |
| 11 | 1.0 | 0.3 | 2.5 | 1.160 | A | A | 3 | Invention |
| 12 | 1.2 | 0.3 | 2.5 | 1.160 | D | D | 3 | Comparison |
| 13 | 1.0 | 0.3 | 2.5 | 1.130 | A | A | 3 | Invention |
| 14 | 1.0 | 0.3 | 2.5 | 1.190 | A | A | 3 | Invention |
| 15 | 1.0 | 0.3 | 2.5 | 1.210 | D | B | 3 | Comparison |
| 16 | 0.5 | 0 | 2.0 | 1.160 | A | E | 3 | Comparison |
| 17 | 0.5 | 0.3 | 2.0 | 1.160 | A | A | 3 | Invention |
| 18 | 0.5 | 10.0 | 2.0 | 1.160 | E | B | 3 | Comparison |
| 19 | 0.5 | 0 | 5.0 | 1.160 | B | E | 30 | Comparison |
| 20 | 0.5 | 0.3 | 5.0 | 1.160 | D | A | 33 | Comparison |
| 21 | 0.5 | 10.0 | 5.0 | 1.160 | E | B | 31 | Comparison |

Results

As shown in Table 2, the examples that satisfied the requirements of the invention in the pH, the specific gravity, the amount of free aminopolycarboxylic acid and the concentration of the bleaching agent suffered no deposition at a low temperature and a high temperature, caused quite slight formation of a ferrous compound, and exhibited good time-lapse stability. The comparative examples that did not satisfy the requirements of the invention were unstable in deposition, formation of a ferrous compound, or both of them.

Example 2

Preparation of Bleaching Agent Part of Blix Processing Composition, No. 1

A bleaching agent part of a blix processing composition having the following formulation was prepared.

| (Blix processing composition) | Bleaching agent part |
|---|---|
| Water | 350 mL |
| Ammonium(III) ethylenediamine tetraacetate | 0.7 mole |
| Ethylenediamine tetraacetic acid | shown in Table 3 |
| m-Carboxysulfinic acid | 20.0 g |
| Organic acid | shown in Table 3 |
| Water to make | 1,000 mL |
| pH (at 25° C., adjusted with ammonia or nitric acid) | shown in Table 2 |
| Specific gravity (at 25° C., adjusted with ammonium nitrate) | 1.160 |

Housing Container 1,300 mL of the bleaching agent part was placed in a container made of high density polyethylene (HDPE) described in FIG. 1 of JP-A-11-282148. The oxygen permeation rate of the container was changed as shown in Table 3 by changing the thickness of the columnar part (side wall).

Evaluation of Deposition Property

The bleaching agent part housed in the container was allowed to stand under a temperature condition at −5° C. or 50° C. for 4 weeks as similar to Example 1. Thereafter, presence of precipitation and deposition was visually observed, and the formation ratio of a ferrous salt compound was measured. The evaluation method and the evaluation standard were the same as in Example 1.

Results

As shown in Table 3, the examples that satisfied the requirements of the invention suffered no deposition at a low temperature and a high temperature, caused quite slight formation of a ferrous compound, and exhibited good time-lapse stability. It was also shown that, among these, the cases where a monobasic acid or a dibasic acid was contained were preferred, and the oxygen permeation rate of the container was preferably 4 mL/24 hrs or less.

Example 3

1. Production of Photosensitive Material Samples

A photosensitive material used for a continuous processing test was produced in the following manner.

Preparation of Blue-sensitive Layer Emulsion A 46.3 mL of a 10% solution of NaCl was added to 1.06 L of deionized distilled water containing 5.7% by weight of deionized gelatin, and 46.4 mL of $H_2SO_4$ (1N) was further added thereto. After adding 0.012 g of the compound X, the temperature was adjusted to 60° C., and under high speed stirring, 0.1 mole of each of silver nitrate and 0.1 mole of NaCl were immediately added to a reaction vessel over 10 minutes. Subsequently, 1.5 mole of silver nitrate and a NaCl solution were added over 60 minutes by a flow rate increasing method, in which the final addition rate was 4 times the initial addition rate. 0.2% by mole of each of silver nitrate and a NaCl solution were added at a constant addition rate over 6 minutes. At this time, $K_3IrCl_5(H_2O)$ was added to the

TABLE 3

| No. | EDTAFe (III) concentration (mole/L) | Organic acid concentration (mole/L) | pH | Oxygen permeability of container (mL/24 hr) | Time-lapse deposition at −5° C. | Time-lapse deposition at 50° C. | Time-lapse $Fe^{2+}$ at 50° C. | Note |
|---|---|---|---|---|---|---|---|---|
| 1 | 0 | — | 2.5 | 10 | B | E | 8 | Comparison |
| 2 | 0.1 | — | 2.5 | 10 | B | A | 8 | Invention |
| 3 | 0.3 | — | 2.5 | 10 | B | A | 8 | Invention |
| 4 | 3.0 | — | 2.5 | 10 | B | A | 8 | Invention |
| 5 | 10.0 | — | 2.5 | 10 | E | B | 1 | Comparison |
| 6 | 0 | succinic acid (0.4) | 2.5 | 10 | A | E | 1 | Comparison |
| 7 | 0.1 | succinic acid (0.4) | 2.5 | 10 | A | A | 1 | Invention |
| 8 | 0.3 | succinic acid (0.4) | 2.5 | 10 | A | A | 1 | Invention |
| 9 | 3.0 | succinic acid (0.4) | 2.5 | 10 | A | A | 1 | Invention |
| 10 | 10.0 | succinic acid (0.4) | 2.5 | 10 | E | B | 1 | Comparison |
| 11 | 0 | acetic acid (0.6) | 2.5 | 10 | A | E | 1 | Comparison |
| 12 | 0.1 | acetic acid (0.6) | 2.5 | 10 | A | A | 1 | Invention |
| 13 | 0.3 | acetic acid (0.6) | 2.5 | 10 | A | A | 1 | Invention |
| 14 | 3.0 | acetic acid (0.6) | 2.5 | 10 | A | A | 1 | Invention |
| 15 | 10.0 | acetic acid (0.6) | 2.5 | 10 | E | B | 1 | Comparison |
| 16 | 0.1 | acetic acid (0.6) | 1.0 | 10 | E | B | 1 | Comparison |
| 17 | 0.1 | acetic acid (0.6) | 4.5 | 10 | E | D | 18 | Comparison |
| 18 | 0.1 | acetic acid (0.6) | 5.5 | 10 | E | D | 33 | Comparison |
| 19 | 0.1 | succinic acid (0.4) | 2.5 | 0.5 | A | A | 12 | Invention |
| 20 | 0.1 | succinic acid (0.4) | 2.5 | 2 | A | A | 10 | Invention |
| 21 | 0.1 | succinic acid (0.4) | 2.5 | 4 | A | A | 3 | Invention |
| 22 | 0.1 | succinic acid (0.4) | 2.5 | 20 | A | A | 1 | Invention |

NaCl solution in an amount of $5\times10^{-7}$ mole per the total silver amount to dope aquotized iridium in the particles.

0.2 mole of silver nitrate, 0.18 mole of NaCl and 0.02 mole of a KBr solution were added over 6 minutes. At this time, $K_4Ru(CN)_6$ and $K_4Fe(CN)_6$ were added to the halogen aqueous solution in amounts of $0.5\times10^{-5}$ mole per the total silver amount, respectively, to add them to the silver halide particles.

In this final stage of particle growth, a KI aqueous solution was added to the reaction vessel in an amount of 0.001 mole per the total silver amount over 1 minute. The start point of the addition was the time when 93% of the total particle formation had been completed.

Thereafter, the compound Y was added as a sedimentation agent at 40° C., and the pH was adjusted to about 3.5, followed by subjecting to desalting and water washing.

Compound X

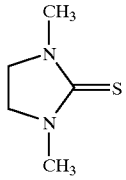

Compound Y

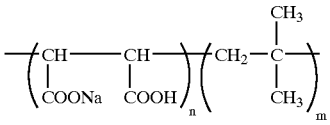

n, m: integer

Deionized gelatin, a NaCl aqueous solution and a NaOH aqueous solution were added to the emulsion having been subjected to desalting and water washing, and the temperature was increased to 50° C., followed by adjusting pAg and pH to 7.6 and 5.6, respectively.

Thus, gelatin containing silver halide cubic particles having a composition of 98.9% by mole of silver chloride, 1% by mole of silver bromide and 0.1% by mole of silver iodide, and having an average edge length of 0.70 μm and a variation coefficient of the edge length of 8% was obtained.

The emulsion particles were maintained at 60° C., to which the spectral sensitizing dyes 1 and 2 were added in an amount of $5\times10^{-4}$ mole and $2.0\times10^{-4}$ mole, respectively, per mole of silver. Furthermore, the thiosulfonic acid compound 1 was added in an amount of $1\times10^{-5}$ mole per mole of silver, and a fine particle emulsion containing 90% by mole of silver bromide and 10% by mole of silver chloride having an average particle diameter of 0.05 μm doped with iridium hexachloride was added, followed by aging for 10 minutes. Fine particles having an average particle diameter of 0.05 μm and containing 40% by mole of silver bromide and 60% by mole of silver chloride were added, followed by aging for 10 minutes. The fine particles were dissolved, whereby the silver bromide content of the host cubic particles were increased to 1.3 mole. Iridium hexachloride was doped in an amount of $1\times10^{-7}$ mole per mole of silver.

Subsequently, $1\times10^{-5}$ mole per mole of silver of sodium thiosulfate and $2\times10^{-5}$ mole of the gold sensitizing agent 1 were added. Immediately thereafter, the temperature was increased to 60° C., followed by aging for 40 minutes, and then the temperature was decreased to 50° C. Immediately after decreasing the temperature, $6\times10^{-4}$ mole per mole of silver of each of the mercapto compounds 1 and 2 were added. After aging for 10 minutes, 0.008 mole per mole of silver of a KBr aqueous solution was added, followed by aging for 10 minutes. The temperature was decreased, and then the emulsion was housed.

Thus, a high sensitive emulsion A-1 was produced.

Cubic particles having an average edge length of 0.55 μm and a variation coefficient of the edge length of 9% were produced in the same manner as in the foregoing preparation process of the emulsion except that the temperature during the particle formation was changed. The temperature during the particle formation was 55° C.

The spectral sensitization and the chemical sensitization were carried out with such amounts that were compensated with respect to the specific surface areas (i.e., the edge length ratio of 0.7/0.55=1.27 times), so as to produce a low sensitive emulsion A-2.

Spectral Sensitizing Dye 1

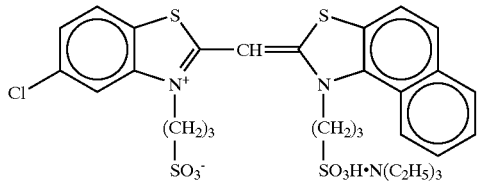

Spectral Sensitizing Dye 2

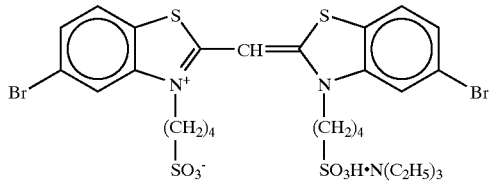

Thiosulfonic Acid Compound 1

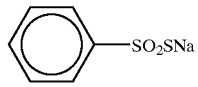

Mercapto Compound 1

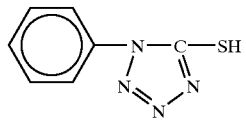

Mercapto Compound 2

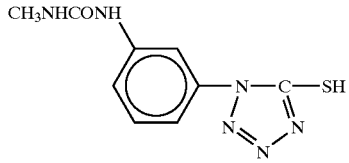

Gold Sensitizing Agent 1

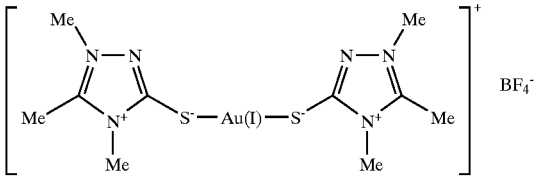

Preparation of Green-sensitive Layer Emulsion C

A green-sensitive high sensitive emulsion C-1 and a green-sensitive low sensitive emulsion C-2 were produced in the same manner as in the production of the emulsions A-1 and A-2 except that the temperature during the particle formation of the emulsion A-1 was lowered, and the species of the spectral sensitizing dyes were changed to the following.

Sensitizing Dye D

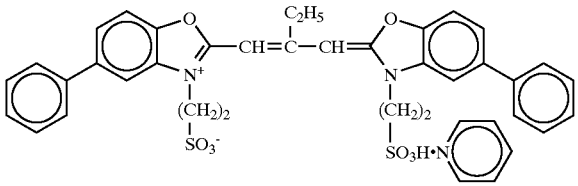

Sensitizing Dye E

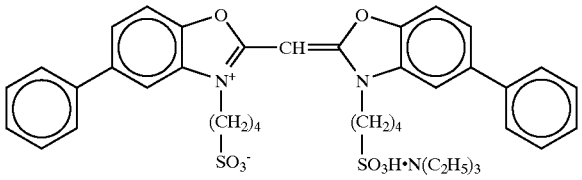

The particle size in terms of the average edge length was 0.40 μm for the high sensitive emulsion and 0.30 μm for the low sensitive emulsion. The variation coefficients thereof were 8% each.

The sensitizing dye D was added in an amount of $3.0\times10^{-4}$ mole per mole of silver for the large size emulsion and $3.6\times10^{-4}$ mole per mole of silver for the small size emulsion, and the sensitizing dye E was added in an amount of $4.0\times10^{-5}$ mole per mole of silver for the large size emulsion and $7.0\times10^{-5}$ mole per mole of silver for the small size emulsion.

Preparation of Red-sensitive Layer Emulsion E

A red-sensitive high sensitive emulsion E-1 and a red-sensitive low sensitive emulsion E-2 were produced in the same manner as in the production of the emulsions A-1 and A-2 except that the temperature during the particle formation of the emulsion A-1 was lowered, and the species of the spectral sensitizing dyes were changed to the following.

Sensitizing Dye G

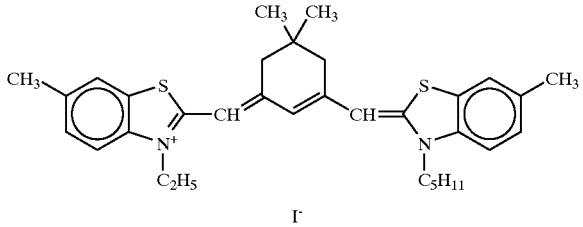

Sensitizing Dye H

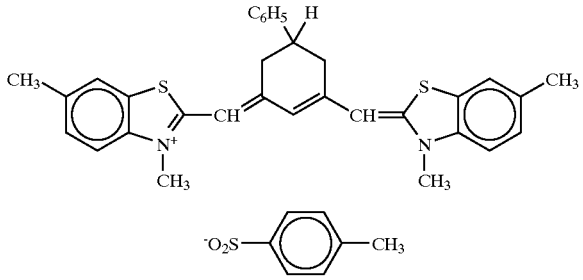

The particle size in terms of the average edge length was 0.38 μm for the high sensitive emulsion and 0.32 μm for the low sensitive emulsion. The variation coefficients thereof were 9% and 10%, respectively.

The sensitizing dyes G and H were added in an amount of $8.0\times10^{-5}$ mole per mole of silver each for the large size emulsion and $10.7\times10^{-5}$ mole per mole of silver each for the small size emulsion.

Furthermore, the following compound I was added to the red-sensitive emulsion layer in an amount of $3.0\times10^{-3}$ mole per mole of silver halide.

Compound I

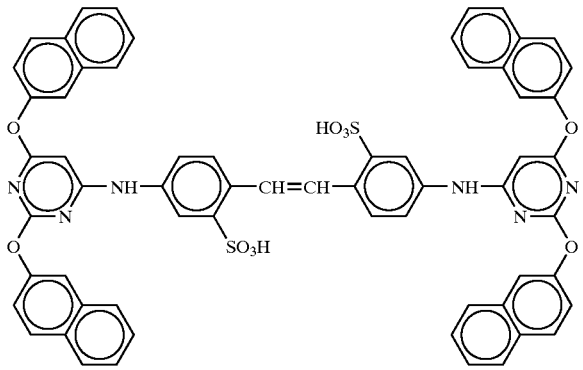

Preparation of Coating Composition for First Layer 57 g of a yellow coupler (ExY-1), 7 g of a color image stabilizer (Cpd-1), 4 g of a color image stabilizer (Cpd-2), 7 g of a color image stabilizer (Cpd-3) and 2 g of a color image stabilizer (Cpd-8) were dissolved in 21 g of a solvent (Solv-1) and 80 mL of ethyl acetate, and the resulting solution was emulsified in 220 g of a 23.5% by weight gelatin aqueous solution containing 4 g of sodium dodecylbenzenesulfonate with a high-speed agitation emulsifier (dissolver), followed by adding water thereto, to prepare 900 g of an emulsion dispersion A.

The emulsion dispersion A and the emulsions A-1 and A-2 were mixed and dissolved to prepare a coating composition for a first layer having the formulation described later. The coated amount of the emulsion is shown in terms of a coated amount converted to silver amount.

Coating compositions for second to seventh layers were prepared in the same manner as in the preparation of the coating composition for the first layer. As gelatin hardeners for the layers, 1-oxy-3,5-dichloro-s-triazine sodium salt (H-1), (H-2) and (H-3) were used. Ab-1, Ab-2, Ab-3 and Ab-4 were added to the layers in total amounts of 15.0 mg/m$^2$, 60.0 mg/m$^2$, 5.0 mg/m$^2$ and 10.0 mg/m$^2$, respectively.

(H-1) Hardener

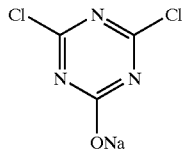

(used in 1.4% by weight per gelatin)

(H-2) Hardener

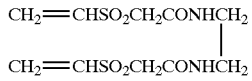

(H-3) Hardener

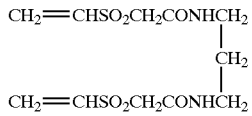

(Ab-1) Antiseptic Agent

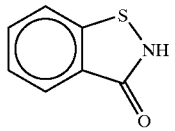

(Ab-2) Antiseptic Agent

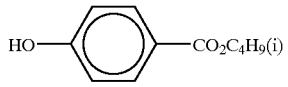

(Ab-3) Antiseptic Agent

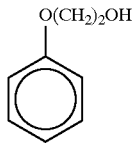

(Ab-4) Antiseptic Agent

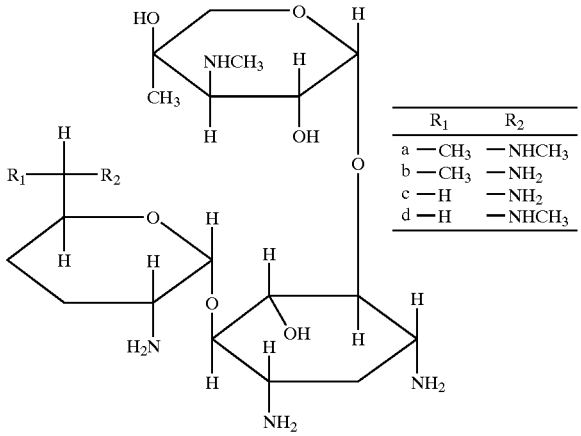

| | $R_1$ | $R_2$ |
|---|---|---|
| a | $-CH_3$ | $-NHCH_3$ |
| b | $-CH_3$ | $-NH_2$ |
| c | $-H$ | $-NH_2$ |
| d | $-H$ | $-NHCH_3$ |

mixture of a/b/c/d at molar ratio of 1/1/1/1

1-(3-Methylureidophenyl)-5-mercaptotetrazole was added to the second layer, the fourth layer, the sixth layer and the seventh layer in amounts of 0.2 mg/m$^2$, 0.2 mg/m$^2$, 0.6 mg/m$^2$ and 0.1 mg/m$^2$, respectively.

4-Hydroxy-6-methyl-1,3,3a,7-tetrazaindene was added to the blue-sensitive emulsion layer and the green-sensitive emulsion layer in an amount of $1\times10^{-4}$ mole per mole of silver halide and $2\times10^{-4}$ mole per mole of silver halide, respectively.

A copolymer latex of methacrylic acid and butyl acrylate (weight ratio: 1/1, average molecular weight: 200,000 to 400,000) was added to the red-sensitive emulsion layer in an amount of 0.05 g/m$^2$.

Disodium catechol-3,5-disulfonate was added to the second layer, the fourth layer and the sixth layer in amounts of 6 mg/m$^2$, 6 mg/m$^2$ and 18 mg/m$^2$, respectively.

The following dyes (values in parenthesis were coated amounts) were added to prevent irradiation.

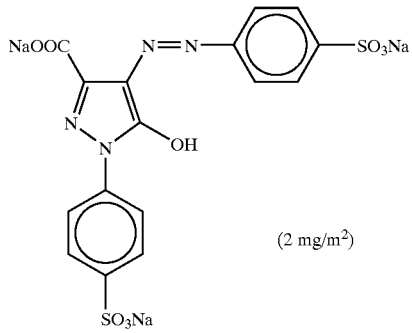

(2 mg/m$^2$)

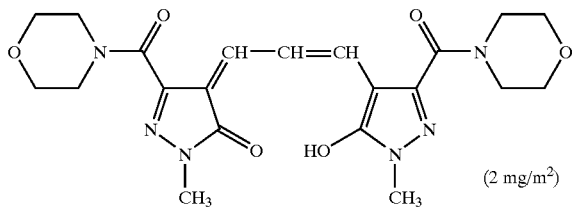

(2 mg/m$^2$)

-continued

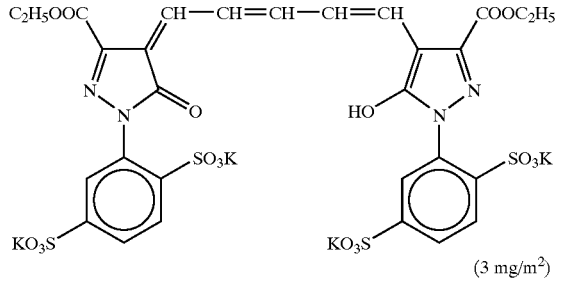

(3 mg/m$^2$)

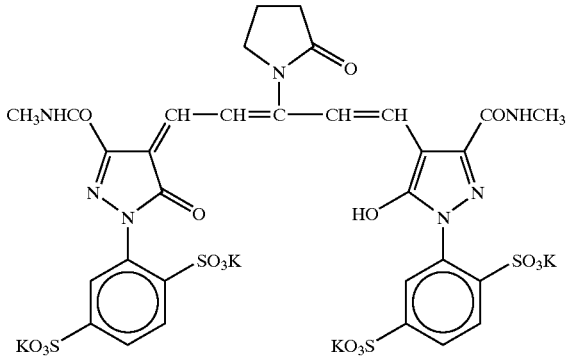

(7 mg/m$^2$)

(Layer Constitution)

The constitutions of the respective layers are shown below. The numerals show coated amounts (g/m$^2$). Those for the silver halide emulsions are shown in terms of coated amounts converted to silver amounts.

Support

Polyethylene Resin-Laminated Paper

A polyethylene resin on the side of the first layer contained white pigments ($TiO_2$; content: 16% by weight, ZnO; content: 4% by weight), a fluorescent whitening agent (4,4'-bis(5-methylbenzoxazolyl)stilbene; content: 0.03% by weight) and a bluish dye (ultramarine; content: 0.33% by weight). The amount of the polyethylene resin was 29.2 g/m$^2$.

| | |
|---|---|
| First layer (blue-sensitive emulsion layer) | |
| Silver bromoiodide emulsion A (cubicparticles subjected to gold sensitization, 3/7 mixture (silver molar ratio) of large size emulsion A-1 and small size emulsion A-2) | 0.24 |
| Gelatin | 1.25 |
| Yellow coupler (ExY-1) | 0.56 |
| Yellow coupler (ExY-2) | 0.56 |
| Color image stabilizer (Cpd-1) | 0.07 |
| Color image stabilizer (Cpd-2) | 0.04 |
| Color image stabilizer (Cpd-3) | 0.07 |
| Color image stabilizer (Cpd-8) | 0.02 |
| Solvent (Solv-1) | 0.21 |
| Second layer (color mixing preventing layer) | |
| Gelatin | 1.15 |
| Color mixing preventing agent (Cpd-4) | 0.10 |
| Color image stabilizer (Cpd-5) | 0.018 |
| Color image stabilizer (Cpd-6) | 0.13 |
| Color image stabilizer (Cpd-7) | 0.07 |
| Solvent (Solv-1) | 0.04 |
| Solvent (Solv-2) | 0.12 |
| Solvent (Solv-5) | 0.11 |
| Third layer (green-sensitive emulsion layer) | |
| Silver chlorobromoiodide emulsion C (cubic particles subjected to gold and sulfur sensitization, 1/3 mixture (silver molar ratio) of large size emulsion C-1 and small size emulsion C-2) | 0.14 |
| Gelatin | 0.46 |
| Magenta coupler (ExM-1) | 0.15 |
| Magenta coupler (ExM-2) | 0.15 |
| Ultraviolet ray absorbing agent (UV-A) | 0.14 |
| Color image stabilizer (Cpd-2) | 0.003 |
| Color image stabilizer (Cpd-4) | 0.002 |
| Color image stabilizer (Cpd-6) | 0.09 |
| Color image stabilizer (Cpd-8) | 0.02 |
| Color image stabilizer (Cpd-9) | 0.01 |
| Color image stabilizer (Cpd-10) | 0.01 |
| Color image stabilizer (Cpd-11) | 0.0001 |
| Solvent (Solv-3) | 0.09 |
| Solvent (Solv-4) | 0.18 |
| Solvent (Solv-5) | 0 |
| Fourth layer (color mixing preventing layer) | |
| Gelatin | 0.68 |
| Color mixing preventing agent (Cpd-4) | 0.06 |
| Color image stabilizer (Cpd-5) | 0.011 |
| Color image stabilizer (Cpd-6) | 0.08 |
| Color image stabilizer (Cpd-7) | 0.04 |
| Solvent (Solv-1) | 0.02 |
| Solvent (Solv-2) | 0.07 |
| Solvent (Solv-5) | 0.065 |
| Fifth layer (red-sensitive emulsion layer) | |
| Silver chlorobromoiodide emulsion E (cubic particles subjected to gold and sulfur sensitization, 5/5 mixture (silver molar ratio) of large size emulsion E-1 and small size emulsion E-2) | 0.10 |
| Gelatin | 1.11 |
| Cyan coupler (ExC-1) | 0.02 |
| Cyan coupler (ExC-3) | 0.01 |
| Cyan coupler (ExC-4) | 0.11 |
| Cyan coupler (ExC-5) | 0.01 |
| Color image stabilizer (Cpd-1) | 0.01 |
| Color image stabilizer (Cpd-6) | 0.06 |
| Color image stabilizer (Cpd-7) | 0.02 |
| Color image stabilizer (Cpd-9) | 0.04 |
| Color image stabilizer (Cpd-10) | 0.01 |
| Color image stabilizer (Cpd-14) | 0.01 |
| Color image stabilizer (Cpd-15) | 0.12 |
| Color image stabilizer (Cpd-16) | 0.01 |
| Color image stabilizer (Cpd-17) | 0.01 |
| Color image stabilizer (Cpd-18) | 0.07 |
| Color image stabilizer (Cpd-20) | 0.01 |
| Ultraviolet ray absorbing agent (UV-7) | 0.01 |
| Solvent (Solv-5) | 0.15 |
| Sixth layer (ultraviolet ray absorbing layer) | |
| Gelatin | 0.46 |
| Ultraviolet ray absorbing agent (UV-B) | 0.35 |
| Compound (S1-4) | 0.0015 |
| Solvent (Solv-7) | 0.18 |
| Seventh layer (protective layer) | |
| Gelatin | 1.00 |
| Acrylic modified copolymer of polyvinyl alcohol (modification degree: 17%) | 0.4 |
| Liquid paraffin | 0.02 |
| Surface active agent (Cpd-13) | 0.02 |

(ExY-1) Yellow Coupler

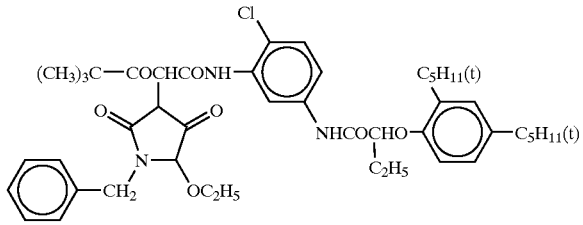

(ExY-2) Yellow Coupler
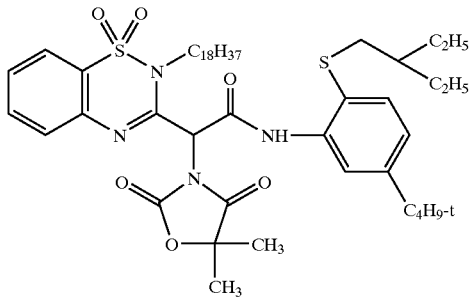
(ExM-1) Magenta Coupler
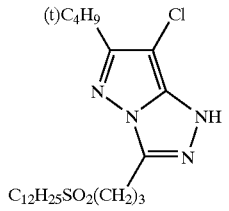
(ExM-2) Magenta Coupler
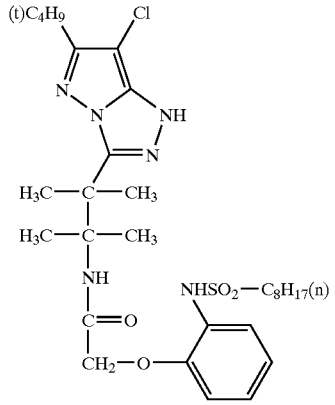
(ExC-1) Cyan Coupler
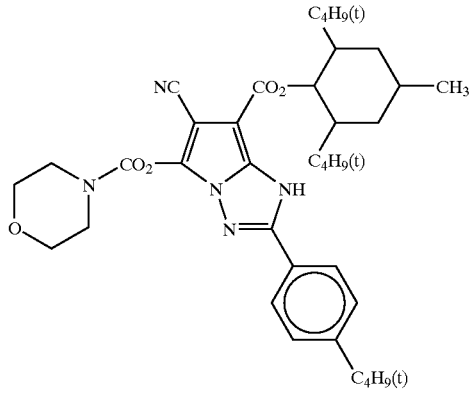
(ExC-2) Cyan Coupler
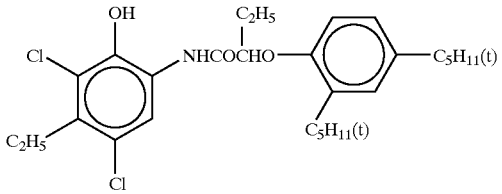
(ExC-3) Cyan Coupler
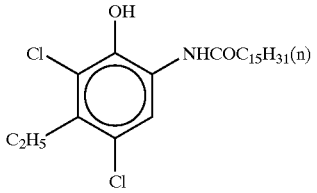
(ExC-4) Cyan Coupler
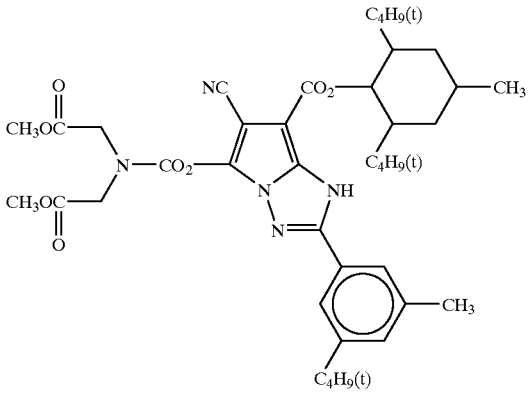
(ExC-5) Cyan Coupler
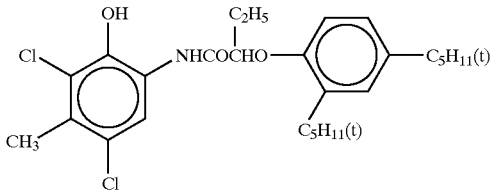
(Cpd-1) Color Image Stabilizer
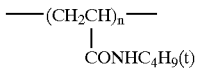
number average molecular weight: 60,000

(Cpd-2) Color Image Stabilizer
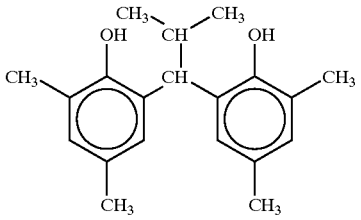
(Cpd-3) Color Image Stabilizer
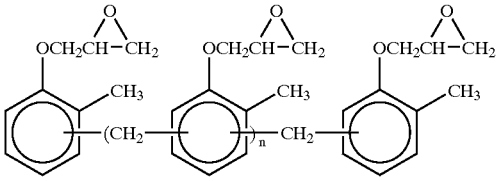
n=7 to 8 (average value)
(Cpd-4) Color Mixing Preventing Agent
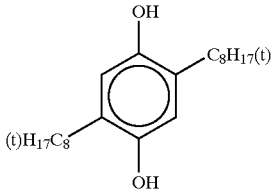
(Cpd-5) Color Image Stabilizer
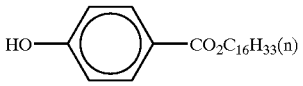
(Cpd-6) Color Image Stabilizer
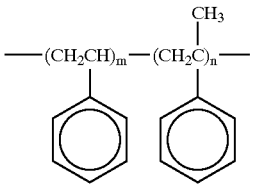
number average molecular weight: 600
m/n=10/90
(Cpd-7) Color Image Stabilizer
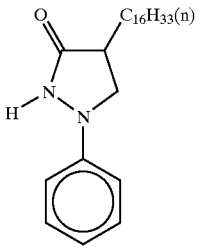
(Cpd-8) Color Image Stabilizer
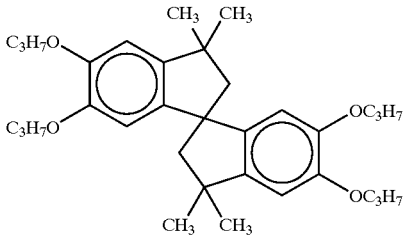
(Cpd-9) Color Image Stabilizer
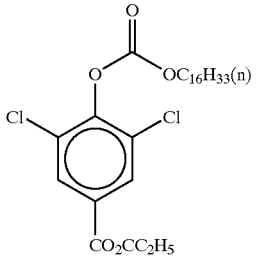
(Cpd-10) Color Image Stabilizer
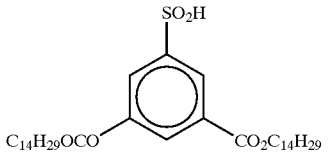
(Cpd-11)
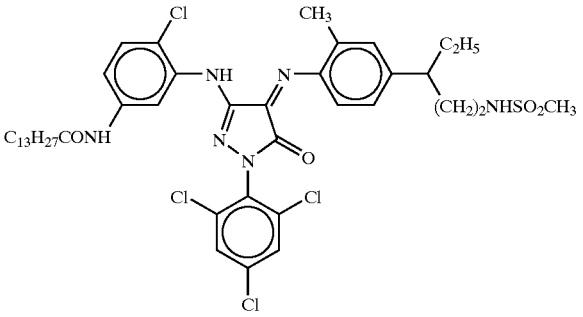
(Cpd-12)
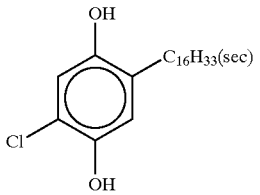

(Cpd-13) Surface Active Agent
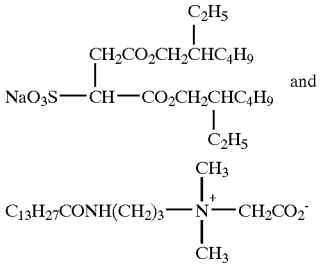
and
mixture at 3/7 (molar ratio)
FS-3
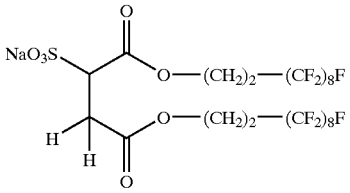
(Cpd-14)
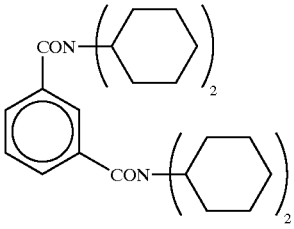
(Cpd-15)
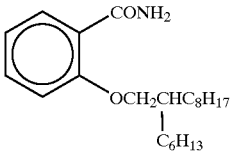
(Cpd-16)
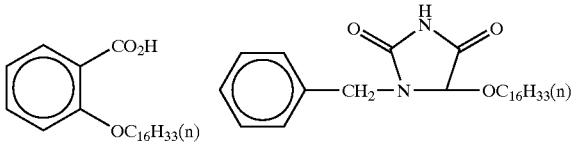
(Cpd-17)
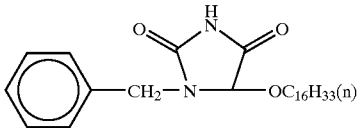
(Cpd-18)
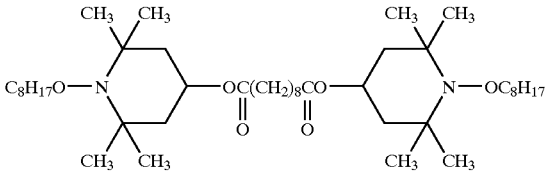
(Cpd-19) Color Mixing Preventing Agent
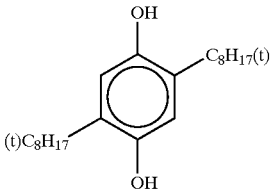
(Cpd-20)
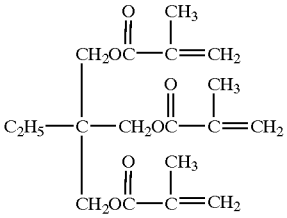
(Solv-1)
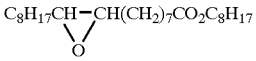
(Solv-2)
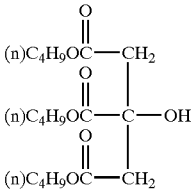
(Solv-3)
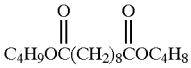
(Solv-4)
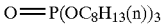
(Solv-5)
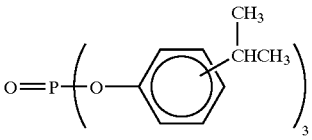
(Solv-7)
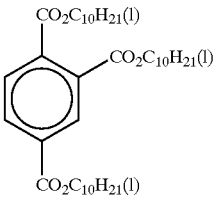

-continued (Solv-8)

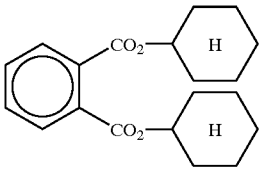

(Solv-9)

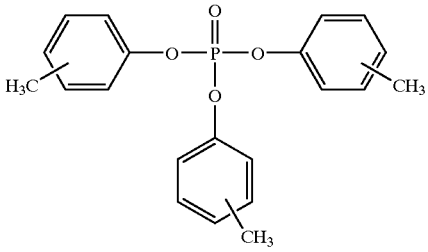

(S1-4)

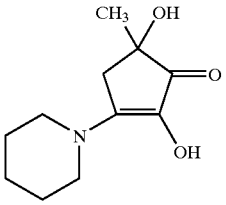

(UV-1) Ultraviolet Ray Absorbing Agent

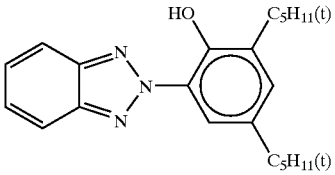

(UV-2) Ultraviolet Ray Absorbing Agent

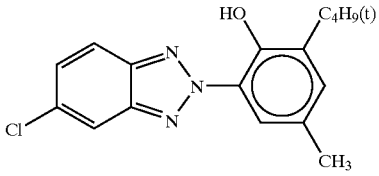

(UV-3) Ultraviolet Ray Absorbing Agent

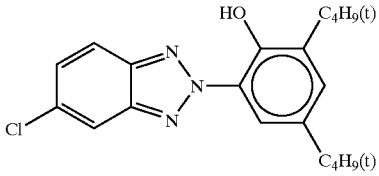

(UV-5) Ultraviolet Ray Absorbing Agent

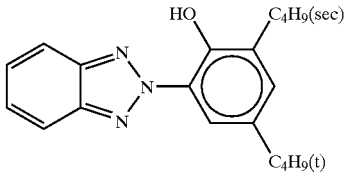

(UV-6) Ultraviolet Ray Absorbing Agent

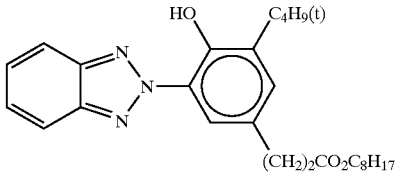

(UV-7) Ultraviolet Ray Absorbing Agent

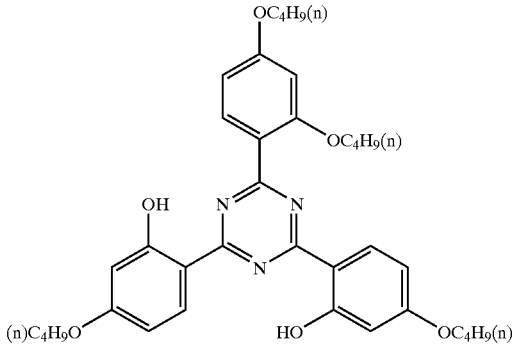

(UV-A) Mixture of UV-1/UV-2/UV-3=7/2/2 (weight ratio)
(UV-B) Mixture of UV-1/UV-2/UV-3/UV-5/UV-6=13/3/3/5/3 (weight ratio)
(UV-C) Mixture of UV-1/UV-3=9/1 (weight ratio)

2. Development Process

Continuous processing was carried out by using a mini-laboratory printer processor, Frontier 330, produced by Fuji Photo Film Co., Ltd. with the following processing steps and processing formulations until three times the liquid amount of the color development tank was replenished. The conveying speed of Frontier 330 was increased to 27.9 mm/sec, and the processing racks of the color developing bath and the blix bath were modified. The rinsing bath and the processing rack thereof were modified to a blade conveying system described in JP-A-2002-55422, the liquid circulation direction was changed to downward (configuration described in Japanese Patent Application No. 2001-147814), and a pleated circulation filter was mounted at the bottom of the tank.

Development process condition

| Process step | Temperature | Time | Replenishing amount |
|---|---|---|---|
| Color development | 45.0° C. | 25 sec | 45 mL/m$^2$ |
| Blix | 40.0° C. | 25 sec | A 17.5 mL/m$^2$<br>B 17.5 mL/m$^2$ |
| Rinsing (1) | 40.0° C. | 7 sec | — |
| Rinsing (2) | 40.0° C. | 4 sec | — |

-continued

| | | | |
|---|---|---|---|
| Rinsing (3) | 40.0° C. | 4 sec | — |
| Rinsing (4) | 40.0° C. | 7 sec | 175 mL/m$^2$ |
| Drying | 80° C. | 20 sec | |

| Color developing solution | Tank | Replenisher |
|---|---|---|
| Cation exchanged water | 800 mL | 800 mL |
| Dimethylpolysiloxane surface active agent (Silicone KF351A, produced by Shin-Etsu Chemical Co., Ltd.) | 0.05 g | 0.05 g |
| Potassium hydroxide | 4.0 g | 9.0 g |
| Sodium hydroxide | 2.0 g | 6.0 g |
| Ethylenediamine tetraacetic acid | 4.0 g | 4.0 g |
| Tiron | 0.5 g | 0.5 g |
| Potassium chloride | 19.0 g | — |
| Sodium bromide | 0.036 g | — |
| P-1 (shown below) | 1.5 g | 2.9 g |
| S-1 (shown below) | 3.5 g | 9.0 g |
| Sodium p-toluenesulfonate | 15.0 g | 15.0 g |
| Sodium sulfite | 0.2 g | 0.2 g |
| m-Carboxysulfinic acid | 2.0 g | 3.6 g |
| Disodium-N,N-bis(sulfonatoethyl) hydroxylamine | 5.0 g | 10.8 g |
| N-Ethyl-N-(β-methanesulfonamideethyl)-3-methyl-4-aminoaniline 3/2 sulfate monohydrate | 6.7 g | 17.3 g |
| Potassium carbonate | 26.3 g | 26.3 g |
| Water to make | 1,000 mL | 1,000 mL |
| pH (at 25° C., adjusted with potassium hydroxide and sulfuric acid) | 10.12 | 10.26 |

| Blix solution | Tank | Replenisher A | Replenisher B |
|---|---|---|---|
| Water | 650 mL | 300 mL | 300 mL |
| Ammonium thiosulfate (750 g/L) | 97.0 mL | — | 376.0 mL |
| Ammonium bisulfite solution (65%) | 13.0 g | — | 185.5 mL |
| Ammonium sulfite | 21.0 g | — | — |
| Aminonium(III) ethylenediamine tetraacetate | 37.0 g | 184.0 g | — |
| Ethylenediamine tetraacetic acid | 1.6 g | 0.4 g | 10.0 g |
| m-Carboxysulfinic acid | 3.0 g | 14.0 g | — |
| Nitric acid | 5.2 g | 25.0 g | — |
| Succinic acid | 6.7 g | 33.0 g | — |
| Imidazole | 1.3 g | — | — |
| Aqueous ammonia (27%) | 3.4 g | — | 36.0 g |
| Water to make | 1,000 mL | 1,000 mL | 1,000 mL |
| pH (at 25° C., adjusted with ammonia and nitric acid) | 5.9 | 2.5 | 5.75 |

| | |
|---|---|
| Rinsing solution (common to tank and replenisher) | 0.02 g |
| Sodium chlorinated isocyanurate | 1,000 mL |
| Deionized water (electroconductivity: 5 μs/cm or less) | |

P-1

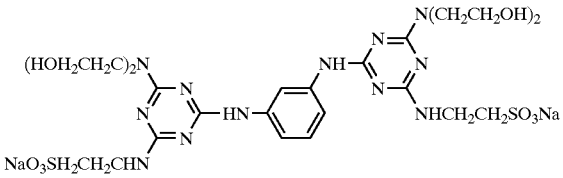

S-1

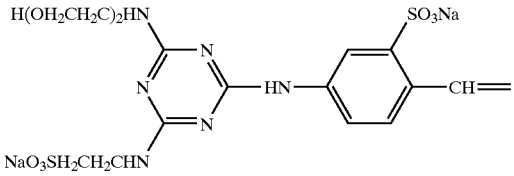

-continued

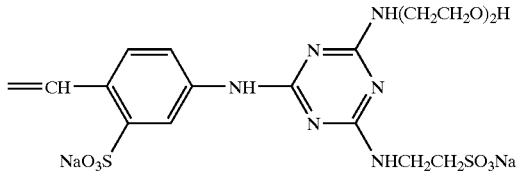

The concentrated replenisher for the color development was formed by diluting the concentrated processing agent with water by 3.84 times by an automatic diluting device of the automatic developing machine. The part A and the part B of the concentrated blix solutions were similarly diluted with water by 1.5 times to make a blix replenisher.

Result

A photosensitive material sample having been processed over the period until three times the liquid amount of the color development tank had been replenished suffered no desilvering failure or color reproduction failure and provided good finished quality. There was no abnormality, such as deposition, in liquid nature in the respective processing bath including the blix bath, and expedited and low-replenishing processing could be carried out.

Example 4

Photosensitive Material Sample

The following development processing was carried out by using the color photosensitive material sample produced in Example 3, and the results obtained were evaluated.

Development Process

Continuous processing was carried out by using a mini-laboratory printer processor, Frontier 350, produced by Fuji Photo Film Co., Ltd. with the following processing steps and processing formulations until three times the liquid amount of the color development bath was replenished. The conveying speed of Frontier 350 was increased to 39.3 mm/sec, and the processing racks of the color developing bath and the blix bath were modified. The rinsing bath and the processing rack thereof were modified to a blade conveying system described in JP-A-2002-55422, the liquid circulation direction was changed to downward (configuration described in Japanese Patent Application No. 2001-147814), and a pleated circulation filter was mounted at the bottom of the tank.

Development Process Condition

| Process step | Temperature | Time | Replenishing amount |
|---|---|---|---|
| Color development | 45.0° C. | 16 sec | 45 mL/m$^2$ |
| Blix | 40.0° C. | 16 sec | A 17.5 mL/m$^2$<br>B 17.5 mL/m$^2$ |
| Rinsing (1) | 40.0° C. | 5 sec | — |
| Rinsing (2) | 40.0° C. | 3 sec | — |
| Rinsing (3) | 40.0° C. | 3 sec | — |
| Rinsing (4) | 40.0° C. | 5 sec | 175 mL/m$^2$ |
| Drying | 80° C. | 16 sec | |

The formulations of the processing solutions were the same as in Example 3.

Results

Even in this example, which was an expedited process at a higher temperature than Example 3, a photosensitive material sample having been processed over the period until three times the liquid amount of the color development tank had been replenished suffered no desilvering failure or color reproduction failure and provided good finished quality. There was no abnormality, such as deposition, in liquid nature in the respective processing bath including the blix bath, and expedited and low-replenishing processing could be carried out.

The blix processing composition according to the invention, which is constituted with a bleaching agent part and a fixing agent part, and the bleaching agent part has pH of from 2.0 to 3.5, a specific gravity of 1.130 or more, a bleaching agent containing an iron(III) complex salt of an aminopolycarboxylic acid, a concentration of the bleaching agent of from 0.5 to 1.0 mole/L, and an aminopolycarboxylic acid having not been complexed contained in an amount of from 0.1 to 3% by mole based on the bleaching agent, suffers no formation of deposit with lapse of time, in which the iron(III) salt is stable, and the process using the processing composition can be carried out in an automatic developing machine in an expedited manner with low replenishment.

The entire disclosure of each and every foreign patent application from which the benefit of foreign priority has been claimed in the present application is incorporated herein by reference, as if fully set forth.

What is claimed is:

1. A concentrated blix solution composition for a silver halide color photographic photosensitive material, which comprises: 1) a concentrated composition part containing a bleaching agent; and 2) a concentrated composition part containing a fixing agent, wherein the concentrated composition part 1) satisfies all the following conditions:

(1) pH is from 2.0 to 3.5, (2) a specific gravity is 1.130 or more, (3) the bleaching agent comprises an iron(III) complex salt of an aminopolycarboxylic acid, (4) a concentration of the bleaching agent is from 0.5 to 1.0 mole/L, and (5) a content of an aminopolycarboxylic acid having not been complexed is from 0.1 to 3% by mole based on the bleaching agent.

2. The concentrated blix solution composition for a silver halide color photographic photosensitive material as claimed in claim 1, wherein the concentrated composition part 1) contains at least one of a monobasic acid and a dibasic acid, which have pKa of from 2 to 5, in an amount of from 0.2 to 1.0 mole/L.

3. The concentrated blix solution composition for a silver halide color photographic photosensitive material as claimed in claim 1, wherein the concentrated composition part 1) contains a dibasic acid having pKa of from 2 to 5 in an amount of from 0.2 to 1.0 mole/L.

4. The concentrated blix solution composition for a silver halide color photographic photosensitive material as claimed in claim 1, wherein the concentrated composition part 1) is housed in a container having an oxygen permeation rate of 4 mL/24 hrs or more.

5. The concentrated blix solution composition for a silver halide color photographic photosensitive material as claimed in claim 1, wherein the concentrated composition part 1) satisfies all the following conditions:

(1) pH is from 2.2 to 3.3, (2) a specific gravity is 1.150 or more, (3) the bleaching agent comprises an iron(III) complex salt of an aminopolycarboxylic acid, (4) a concentration of the bleaching agent is from 0.6 to 0.9 mole/L, and (5) a content of an aminopolycarboxylic acid having not been complexed is from 0.2 to 2.7% by mole based on the bleaching agent.

6. A process for processing a silver halide color photographic photosensitive material, comprising processing the photosensitive material by using the concentrated blix solution composition as claimed in claim 1.

7. The process for processing a silver halide color photographic photosensitive material as claimed in claim 6, wherein a blix processing time is 30 seconds or less.

8. The process for processing a silver halide color photographic photosensitive material as claimed in claim 6, wherein a total replenishing amount of a replenisher for the blix solution is from 20 to 50 mL per 1 $m^2$ of the photosensitive material.

9. The process for processing a silver halide color photographic photosensitive material as claimed in claim 6, wherein the concentrated composition part 1) and the concentrated composition part 2) are mixed to form the blix solution.

10. The process for processing a silver halide color photographic photosensitive material as claimed in claim 6, wherein the concentration of the bleaching agent in the blix solution prepared from the concentrated composition part 1) is from 0.01 to 1.0 mole/L.

11. The process for processing a silver halide color photographic photosensitive material as claimed in claim 6, wherein the concentration of the fixing agent in the blix solution prepared from the concentrated composition part 2) is from 0.3 to 3 mole/L.

12. The process for processing a silver halide color photographic photosensitive material as claimed in claim 6, wherein the blix solution has a pH of 3 to 8.

* * * * *